US005492095A

United States Patent [19]

Hara et al.

[11] Patent Number: 5,492,095

[45] Date of Patent: Feb. 20, 1996

[54] THROTTLE VALVE CONTROL FOR INTERNAL COMBUSTION ENGINE

[75] Inventors: Mitsuo Hara, Aichi; Shigeru Kamio, Nagoya, both of Japan

[73] Assignee: Nippondenso Co., Ltd., Kariya, Japan

[21] Appl. No.: 295,426

[22] Filed: Aug. 25, 1994

[30] Foreign Application Priority Data

Aug. 26, 1993 [JP] Japan ..... 5-211444

[51] Int. Cl.$^6$ ..... F02D 9/10; F02D 11/10

[52] U.S. Cl. ..... 123/339.19; 123/399

[58] Field of Search ..... 123/339.14, 339.19, 123/339.21, 361, 399, 403

[56] References Cited

U.S. PATENT DOCUMENTS

| | | | |
|---|---|---|---|
| 4,432,317 | 2/1984 | Kawamura | 123/339.19 |
| 4,475,503 | 10/1984 | Nakamura et al. | 123/339.19 |
| 4,519,361 | 5/1985 | Murakami | 123/399 |
| 4,765,296 | 8/1988 | Ishikawa et al. | 123/399 |
| 4,823,749 | 4/1989 | Elsenmann et al. | 123/399 |
| 5,024,197 | 6/1991 | Nakamura | 123/339.14 |
| 5,146,888 | 9/1992 | Sawamoto | 123/339 |
| 5,320,076 | 6/1994 | Reppich et al. | 123/399 |

FOREIGN PATENT DOCUMENTS

| | | |
|---|---|---|
| 17734 | 1/1992 | Japan . |
| 41944 | 2/1992 | Japan . |
| 332191 | 12/1993 | Japan . |
| 321743 | 12/1993 | Japan . |
| 2209231 | 5/1989 | United Kingdom . |

*Primary Examiner*—Willis R. Wolfe

*Attorney, Agent, or Firm*—Cushman, Darby & Cushman

[57] ABSTRACT

A throttle valve control apparatus for internal combustion engine stabilizes the engine speed in idle operation by always correcting the full closing reference position in ISC using a single throttle valve. Signals of a neutral position signal, air conditioner signal, electrical load signal, accelerator position signal, engine speed, and water temperature are inputted to a CPU in an electronic control unit via an input circuit. The CPU calculates such a throttle opening as to make the actual speed of the internal combustion engine in idle operation equal to a target speed in idle operation stored beforehand, compares the throttle opening with preset upper limit value and lower limit value of the throttle opening in idle operation, and corrects the full closing reference position of the throttle opening on the basis of the result of comparison. As a result, the full closing reference position in the throttle opening of the throttle valve is always corrected.

11 Claims, 18 Drawing Sheets

| XAC | XNSW | THW | |
|---|---|---|---|
| | | 50℃ OR BELOW | 80℃ OR ABOVE |
| OFF | ON | 0 | 0 |
| | OFF | 0.210 | 0.235 |
| ON | ON | 0.410 | 0.938 |
| | OFF | 0.473 | 1.875 |

[deg]

| WELS | XNSW | TIDLE |
|---|---|---|
| OFF | ON | 0 |
| | OFF | 0 |
| ON | ON | 0.105 |
| | OFF | 0.245 |

[deg]

| XNSW | XAC | THW | | |
|---|---|---|---|---|
| | | 80℃ OR ABOVE | 50℃ | 0℃ OR BELOW |
| OFF | OFF | 600 | 700 | 800 |
| | ON | 700 | 750 | 800 |
| ON | OFF | 650 | 850 | 1000 |
| | ON | 800 | 900 | 1000 |

[rpm]

THROTTLE VALVE CONTROL FOR INTERNAL COMBUSTION ENGINE

BACKGROUND OF THE INVENTION

1. Field of the Invention

The present invention relates to a throttle valve control apparatus for internal combustion engine which carries out various controls on the basis of full closing reference position of a throttle valve.

2. Description of the Related Art

Conventionally as the related art, there are known, for example, a full closing position learning apparatus of throttle valve for internal combustion engine disclosed in JP-A-4-17734 by Satoru Watanabe and an output control apparatus for internal combustion engine disclosed in JP-A-4-41944 by Takeo Kume. In these apparatuses, the mechanically full closing position of the throttle valve is learned at the time of idling or turning on of the ignition switch and adopted as the full closing reference position and then control is carried out for traction and others. Furthermore, as the related art, an air intake control apparatus for internal combustion engine disclosed in JP-A-63-263239 (corresponding to U.S. Pat. No. 4,823,749) by Manfred Eisenmann et al. is known. In this control apparatus, idle speed control (hereafter also referred to as "ISC") and output control according to ordinary accelerator pedal actuation are carried out with a single throttle valve.

In the apparatus having the full closing reference position of the throttle valve set mechanically as described in the aforementioned related art papers, a position deviation occurs in the full closing reference position thereof because of assemble error from vehicle to vehicle and a change with the passage of time. Although the same signal is supplied to actuators for opening/closing the throttle valves, therefore, actual air intake flows passed through the throttle valves are, unadvantageously, not uniform. Furthermore, if the throttle valve is made fully open during engine starting, the engine is stalled. Therefore, it is impossible to find the full closing reference position by fully closing the throttle valve.

SUMMARY OF THE INVENTION

Therefore, the present invention has been made to solve the above described disadvantages. An object of the present invention is to provide a throttle valve control apparatus for internal combustion engine capable of suitably exercising both idle speed control and output control according to ordinary accelerator pedal actuation with a single throttle valve.

A throttle valve control apparatus for internal combustion engine according to a first aspect of the present invention includes idle speed control means for controlling a single throttle valve on the basis of an opening of the throttle valve calculated so as to make an actual speed in idle operation of the internal combustion engine equal to a target speed in idle operation stored beforehand, comparison means for comparing the opening of the throttle valve in idle operation calculated by the idle speed control means with an upper limit value and a lower limit value preset for the opening of the throttle valve in idle operation, and correction means for correcting a full closing reference position of the opening of the throttle valve on the basis of a result of comparison made in the comparison means.

A throttle valve control apparatus for internal combustion engine according to a second aspect of the present invention includes idle speed control means for controlling a single throttle valve on the basis of an opening of the throttle valve calculated so as to make an actual speed in idle operation of the internal combustion engine equal to a target speed in idle operation stored beforehand, adding means for calculating the sum of the throttle opening in idle operation calculated by the idle speed control means, a throttle opening calculated in output control caused by ordinary actuation of the accelerator pedal except the idle speed control means, and a full closing reference position of the throttle opening, and throttle opening control means for controlling the throttle opening of the throttle valve so as to make it coincide with the target throttle opening calculated by the adding means.

In accordance with the first aspect, the throttle opening in idle operation calculated by the idle speed control means using the single throttle valve is compared with the upper limit value and the lower limit value preset for the opening of the throttle valve in idle operation. When the throttle opening in idle operation is not in a predetermined range set by the upper limit value and the lower limit value, the full closing reference position of the throttle opening is judged to be inadequate. When the throttle opening in idle operation is greater than or equal to the upper limit value, the full closing reference position is increased by a predetermined value and a correction is made so that the throttle opening based upon the full closing reference position may not be greater than or equal to the upper limit value. When the throttle opening in idle operation is less than or equal to the lower limit value, the full closing reference position is decreased by a predetermined value and a correction is made so that the throttle opening based upon the full closing reference position may not be less than or equal to the lower limit value. Owing to this correction, the deviation in throttle opening between the actual speed in idle operation and the target speed, which is based upon a change of the full closing reference position caused by a change with the passage of time and so on, comes in a predetermined range set by the upper limit value and the lower limit value.

In accordance with the second aspect, the throttle opening in idle operation calculated by the idle speed control means using the single throttle valve, the throttle opening calculated in output control caused by ordinary actuation of the accelerator pedal except the idle speed control means, and the full closing reference position of the throttle opening are added together. The throttle opening of the throttle valve is controlled so as to make it coincide with the throttle opening thus added together. Therefore, the throttle opening in output control caused by ordinary actuation of the accelerator pedal contains the throttle opening in idle operation. As a result, the throttle valve is opened or closed continuously and smoothly.

DESCRIPTION OF THE PREFERRED EMBODIMENTS

Hereafter, the present invention will be described by referring to concrete examples.

Figure 1:
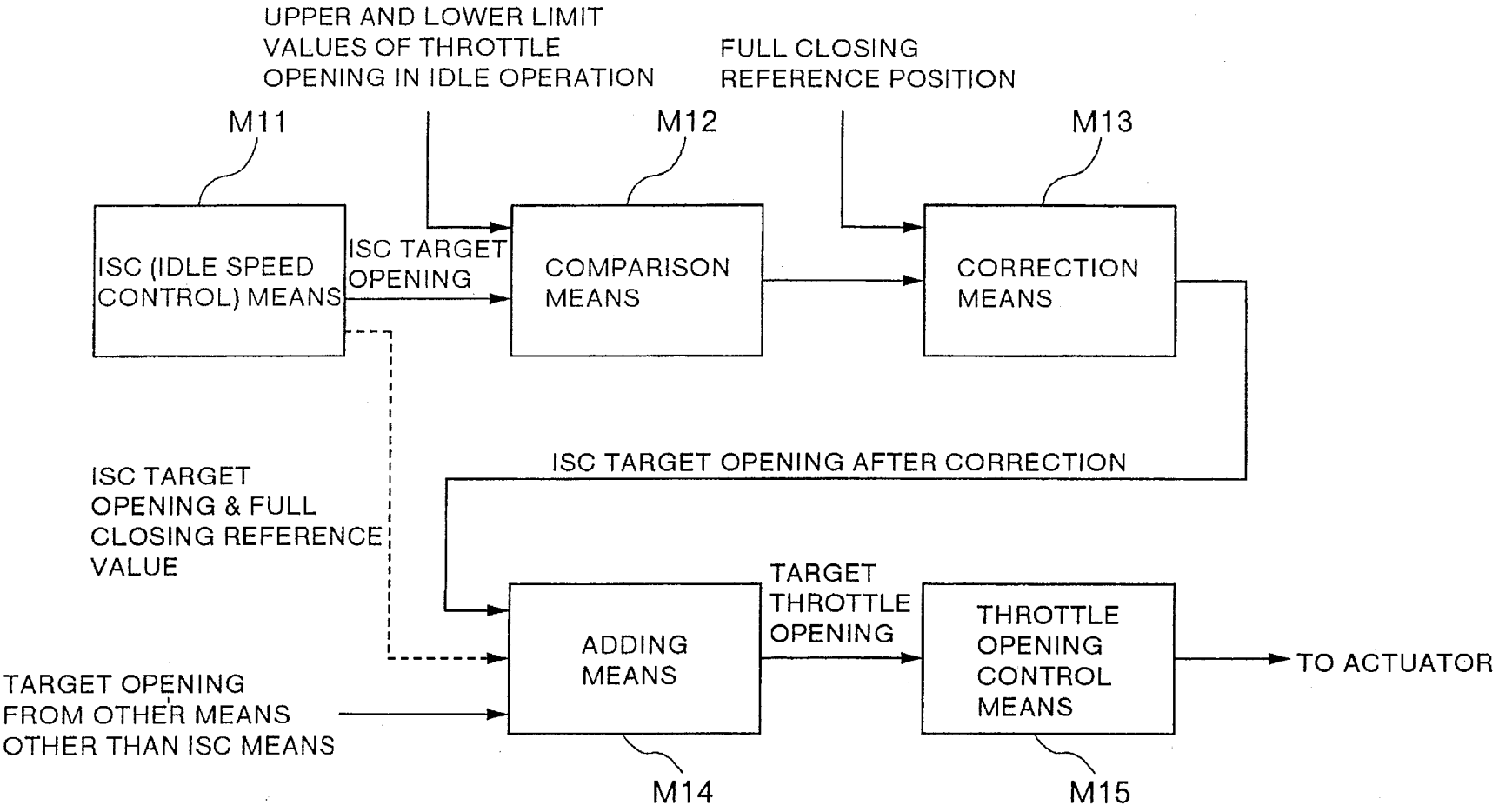
FIG. 1 is a control block diagram showing a throttle valve control apparatus for internal combustion engine according to an embodiment of the present invention.

FIG. 1 is a control block diagram showing a throttle valve control apparatus for internal combustion engine according to an embodiment of the present invention.

A throttle valve control apparatus according to the present invention includes idle speed control (ISC) means M11, comparison means M12, correction means M13, adding means M14, and throttle opening control means M15.

In FIG. 1, an ISC target opening (or an ISC base opening or an ISC learning value) which will be described later is a throttle opening in idle operation calculated by the ISC means M11. The ISC target opening is inputted to the comparison means M12. In the comparison means M12, the ISC target opening is compared with the upper limit value and the lower limit value preset for the ISC target opening. It is thus determined whether the ISC target opening is within the range between the upper limit value and the lower limit value. On the basis of the result of the comparison made in the comparison means M12, the correction means M13 carries out correction of the full closing reference position. This ISC target opening corrected in full closing reference position is inputted to the adding means M14. The adding means M14 is supplied with the ISC target opening after correction fed from the correction means M13, the ISC target opening and full closing reference position fed from the ISC means M11 when the full closing reference position is not corrected, and the target opening of the throttle valve for means other than the ISC means M11. They are added together to calculate the target throttle opening. The throttle opening control means M15 outputs a signal to an actuator, which will be described later, so as to attain coincidence with the target throttle opening fed from the adding means M14 and controls the throttle opening of the throttle valve. Among the above described control blocks, the ISC means M11, the comparison means M12, and the correction means M13 form an embodiment of a first aspect of the present invention. The ISC means M11, the adding means M14, and the throttle opening control means M15 form an embodiment of a second aspect of the present invention.

Figure 2:
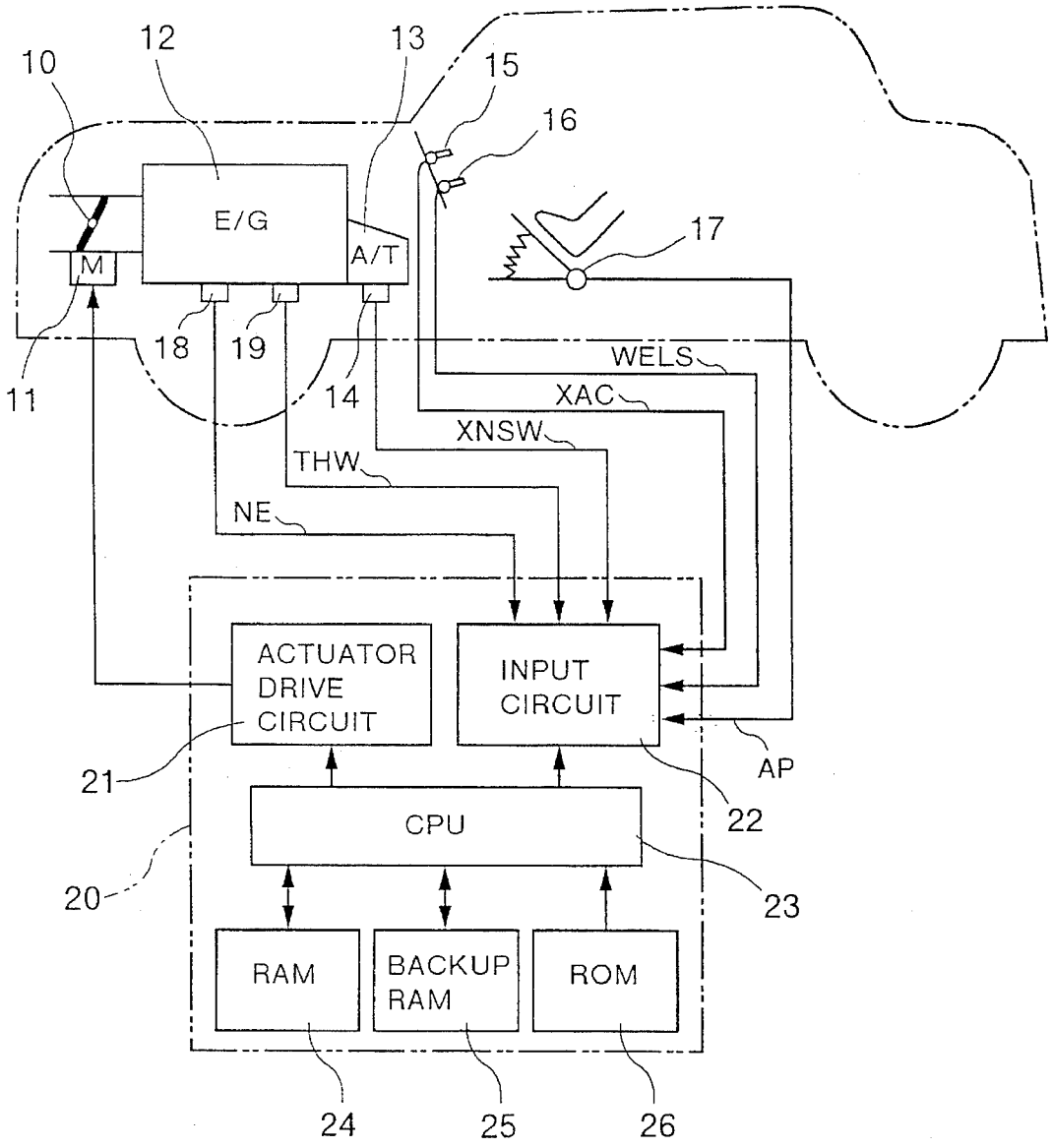
FIG. 2 is an entire configuration diagram showing a throttle valve control apparatus for internal combustion engine according to an embodiment of the present invention.

FIG. 2 is an entire configuration diagram showing a throttle valve control apparatus for internal combustion engine according to an embodiment of the present invention.

In FIG. 2, numeral 10 denotes a throttle valve disposed in an intake pipe, 11 an actuator including a stepping motor for opening/closing the throttle valve 10, 12 an internal combustion engine (E/G), and 13 an automatic transmission (A/T). Numeral 14 denotes a neutral position switch for outputting a neutral position signal (XNSW) in response to the neutral position of the automatic transmission 13. Numeral 15 denotes an air conditioner switch for outputting an air conditioner signal (XAC) in response to ON/OFF of an air conditioner. Numeral 16 denotes an electrical load switch for outputting an electrical load signal (WELS) in response to ON/OFF of a head lamp, a fog lamp, or the like. Numeral 17 denotes an accelerator position sensor for detecting the actuation position of the accelerator pedal and outputting an accelerator position signal (AP). Numeral 18 denotes an engine speed sensor for detecting an engine speed (NE) of the internal combustion engine. Numeral 19 denotes a water temperature sensor for detecting the temperature of radiator cooling water used to cool the internal combustion engine 12 and outputting the water temperature (THW). Furthermore, numeral 20 denotes an electronic control unit (ECU). Numeral 21 denotes an actuator drive circuit for outputting a drive signal to the actuator 11. Numeral 22 denotes an input circuit supplied with the above described signals from various switches and sensors to conduct processing such as A/D conversion. Numeral 23 denotes a CPU, 24 a RAM for storing various data, 25 a backup RAM backed up by a battery to store maps and the like, and 26 a ROM for storing a program and the like.

Flow charts of FIGS. 3 to 26 show the processing procedure of the CPU 23 used in a throttle valve control apparatus for internal combustion engine according to an embodiment of the present invention. Action of the throttle valve control apparatus will hereafter be described by referring to FIGS. 3 to 26.

Figure 3:
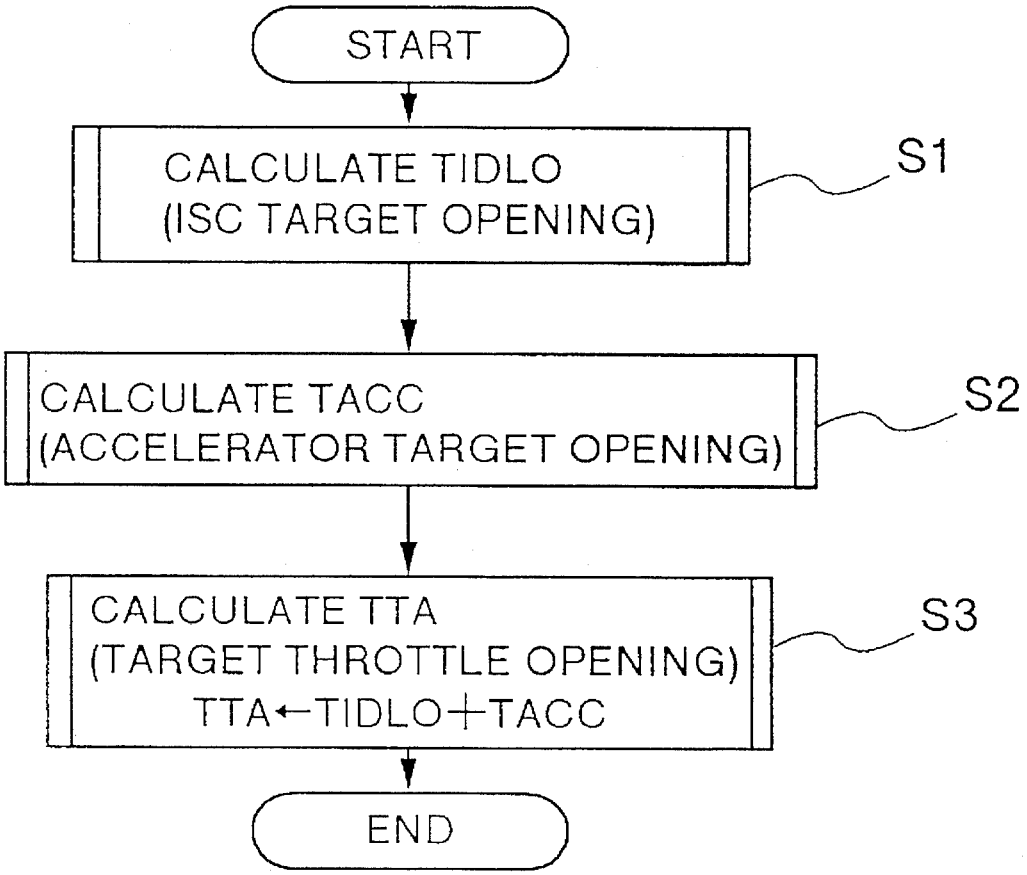
FIG. 3 is a main routine diagram showing a processing procedure for calculating TAA (target throttle opening) in a throttle valve control apparatus for internal combustion engine according to an embodiment of the present invention.

<Main routine for calculating TAA (target throttle opening) shown in FIG. 3>

FIG. 3 shows a main routine for calculating TAA (target throttle opening). At step S1, processing for calculating TIDLO corrected in full closing reference (ISC target throttle opening after correction) is carried out. At the next step S2, processing for calculating TACC (accelerator target opening) is carried out. At step S3, TIDLO (ISC target throttle opening after correction) supplied from the step S1 and TACC (accelerator target opening) supplied from the step S2 are added together to calculate TAA (target throttle opening). In idle operation involving no actuation of the accelerator pedal, AP (accelerator position signal) supplied from the accelerator position sensor 17 has a value of 0 at step S2 and TACC (accelerator target opening) becomes 0. In this case, therefore, processing of the step S2 can be omitted and TAA (target throttle opening) of the step S3 becomes equal to TIDLO (ISC target opening after correction) calculated at step S1. That is to say, the throttle valve control apparatus for internal combustion engine corresponding to the embodiment of the first aspect is achieved by this main routine.

Figure 4:
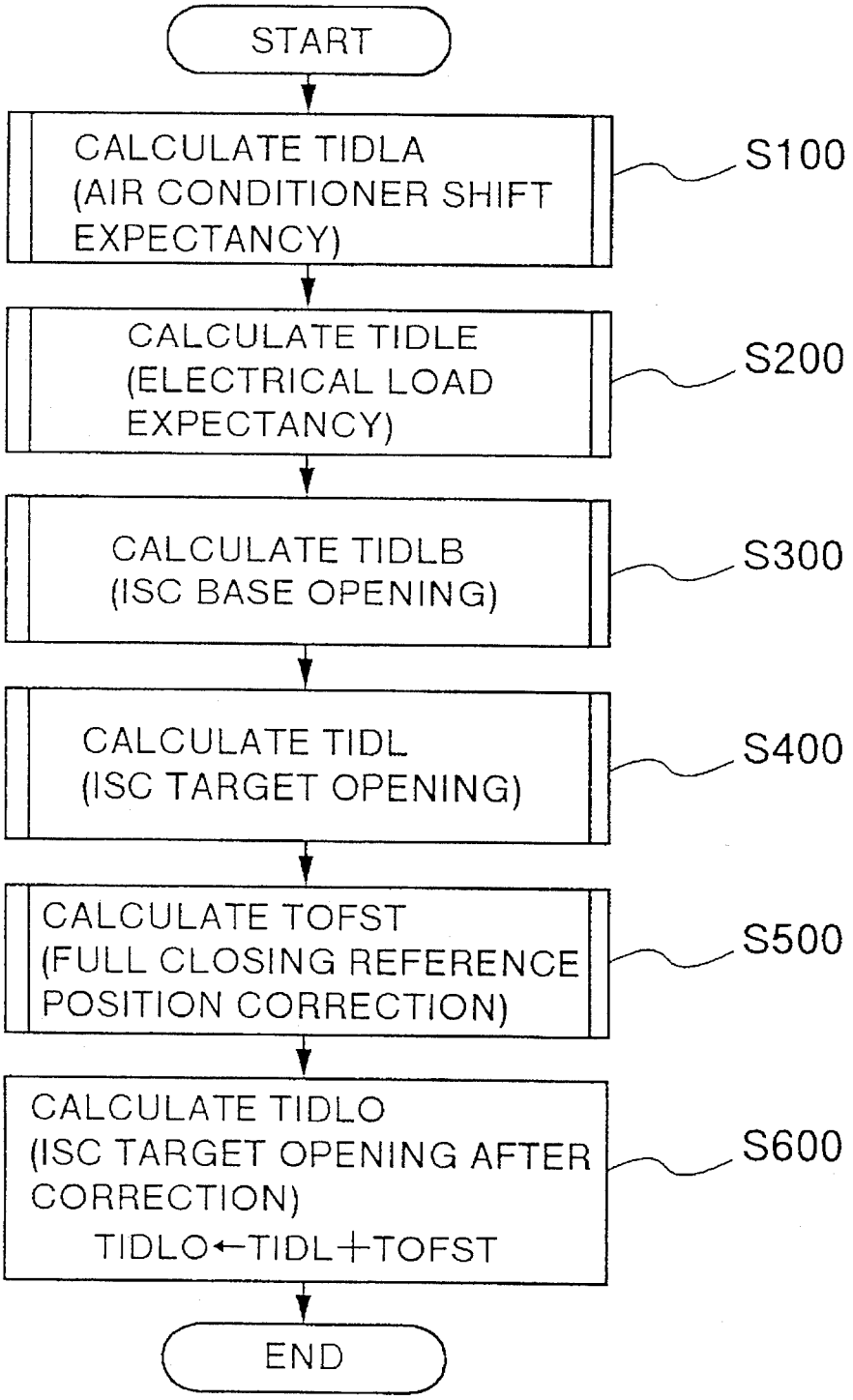
FIG. 4 is a main routine diagram showing a processing procedure for calculating TIDLO (ISC target opening after correction) shown in FIG. 3.

<Main routine for calculating TIDLO (ISC target opening after correction) shown in FIG. 4>

A concrete procedure for calculating TIDLO (ISC target throttle opening after correction) at step S1 of FIG. 3 will hereafter be described. FIG. 4 shows a main routine for calculating TIDLO (ISC target opening after throttle correction).

Figures 5, 6:
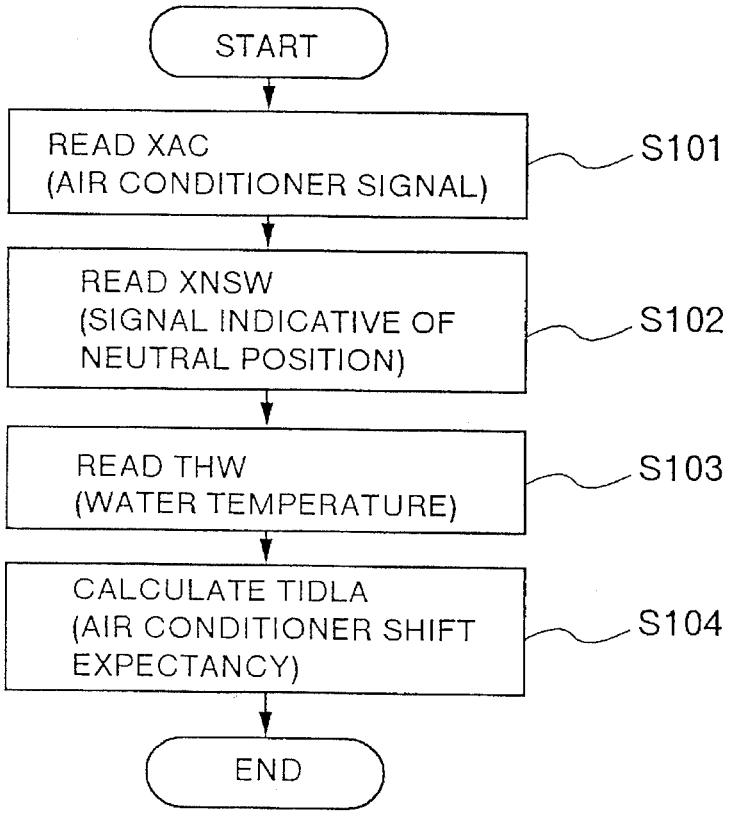
FIG. 5 is a subroutine diagram showing a processing procedure for calculating TIDLA (expectancy of air conditioner shift) shown in FIG. 4.
FIG. 6 shows a map used in the subroutine of FIG. 5.

<Subroutine for calculating TIDLA (air conditioner shift expectancy) shown in FIG. 5>

First of all, at step S100, processing for calculating TIDLA (air conditioner shift expectancy) is carried out on the basis of FIGS. 5 and 6. This TIDLA (air conditioner shift expectancy) refers to an angle change value of the throttle valve for coping with an increase of electrical load caused by use of an air conditioner (not illustrated). In the subroutine shown in FIG. 5, XAC (air conditioner signal) supplied from the air conditioner switch 15 is read at step S101. If XAC (air conditioner signal) is a logic 1 (high level), it is recognized that the air conditioner switch 15 is in the on-state and the air conditioner is in use. If XAC (air conditioner signal) is a logic 0 (low level), it is recognized that the air conditioner switch 15 is in the off-state and the air conditioner is not yet used. Then processing proceeds to step S102 and XNSW (neutral position signal) supplied from the neutral position switch 14 is read. If XNSW (neutral position signal) is a logic 1 (high level), it is recognized that the neutral position switch 14 is in the on-state and the shift position is "neutral." If XNSW (neutral position signal) is a logic 0 (low level), it is recognized that the neutral position switch 14 is in the off-state and the shift position is not "neutral." Then processing proceeds to step S103, and THW (water temperature) supplied from the water temperature sensor 19 is read. Processing proceeds to step S104, and TIDLA (air conditioner expectancy) having degree taken as the unit, for XAC (air conditioner signal), XNSW (neutral position signal), and THW (water temperature) which have been read is calculated from the map of FIG. 6. For example, if XAC (air conditioner signal) is in the on-state (in use), XNSW (neutral position signal) in the on-state (neutral position), and THW (water temperature) is 50° C., then it follows that TIDLA (air conditioner shift expectancy)= 0.410 degree. When THW (water temperature) is between 50° C. and 80° C. in FIG. 6, TIDLA (air conditioner shift expectancy) is calculated by means of interpolation.

Figures 7, 8:
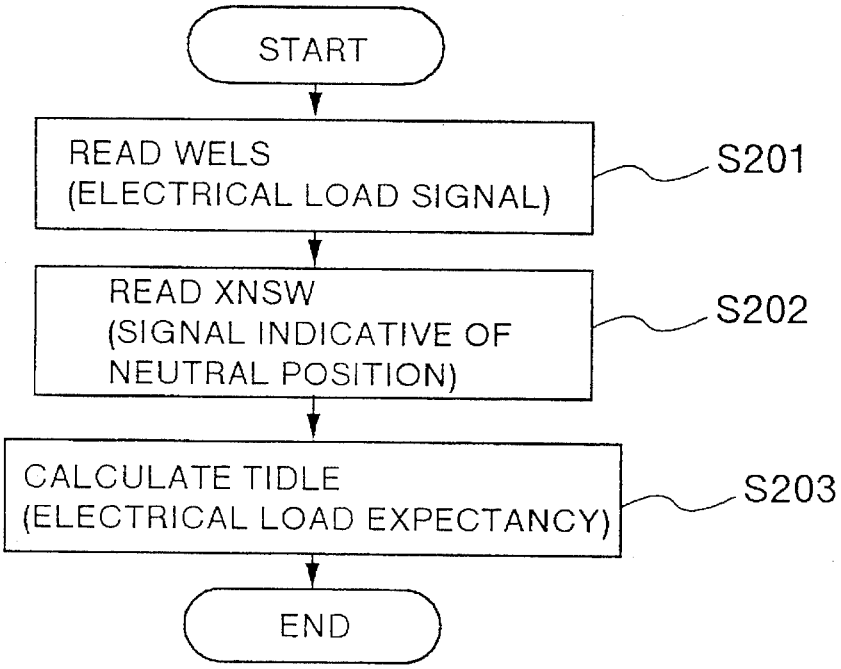
FIG. 7 is a subroutine diagram showing a processing procedure for calculating TIDLE (expectancy of electric load) shown in FIG. 4.
FIG. 8 shows a map used in the subroutine of FIG. 7.

<Subroutine for calculating TIDLE (electrical load expectancy) shown in FIG. 7>

Then processing proceeds to step S200 shown in FIG. 4, and processing for calculating TIDLE (electrical load expectancy) is carried out on the basis of FIGS. 7 and 8. This TIDLE (electrical load expectancy) refers to an angle change value of the throttle valve for coping with an increase of electrical load caused by, for example, turning on of the head lamp or the fog lamp at night. In the subroutine shown in FIG. 7, WELS (electrical load signal) supplied from the electrical lead switch 16 is read at step S201. If WELS (electrical lead signal) is a logic 1 (high level), it is recognized that the electrical lead switch 16 is in the on-state and the above described head lamp or the like is being lit up. If WELS (electrical lead signal) is a logic 0 (low level), it is recognized that the electrical lead switch 16 is in the off-state and the above described head lamp or the like is not being lit. Then processing proceeds to step S202, and XNSW (neutral position signal) supplied from the neutral position switch 14 is read. Processing proceeds to step S203, and TIDLE (electrical lead expectancy) having degree taken as the unit, for WELS (electrical lead signal) and XNSW (neutral position signal) which have been read is calculated from the map of FIG. 8. For example, if WELS (electrical lead signal) is in the on-state (the head lamp or the like is being lit up) and XNSW (neutral position signal) in the on-state (neutral position position), then it follows that TIDLE (electrical lead expectancy)= 0.105 degree.

Figure 9:
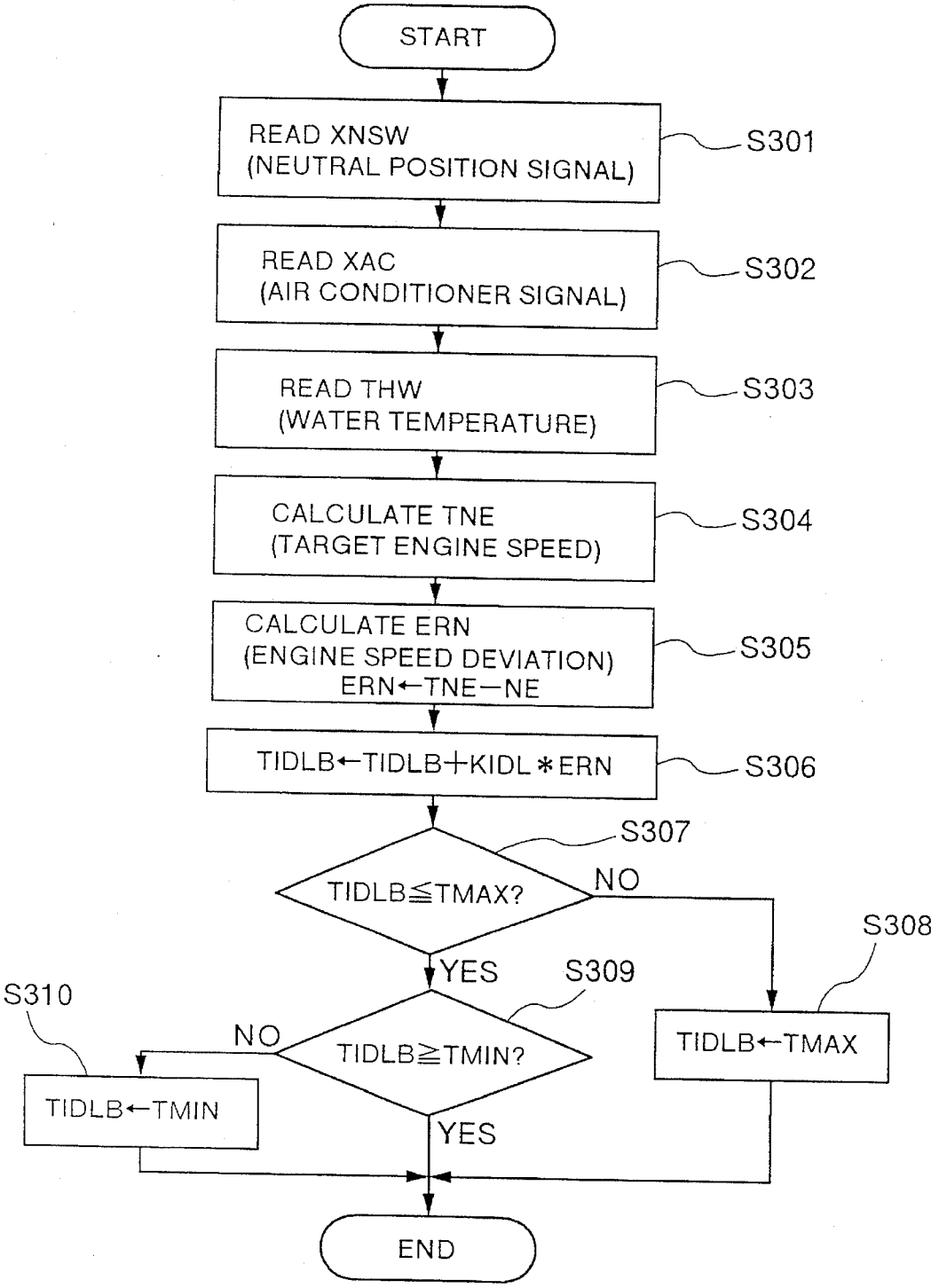
FIG. 9 is a subroutine diagram showing a processing procedure for calculating TIDLB (ISC base opening) shown in FIG. 4.

<Subroutine for calculating TIDLB (ISC base throttle opening) shown in FIG. 9>

Figures 10, 11:
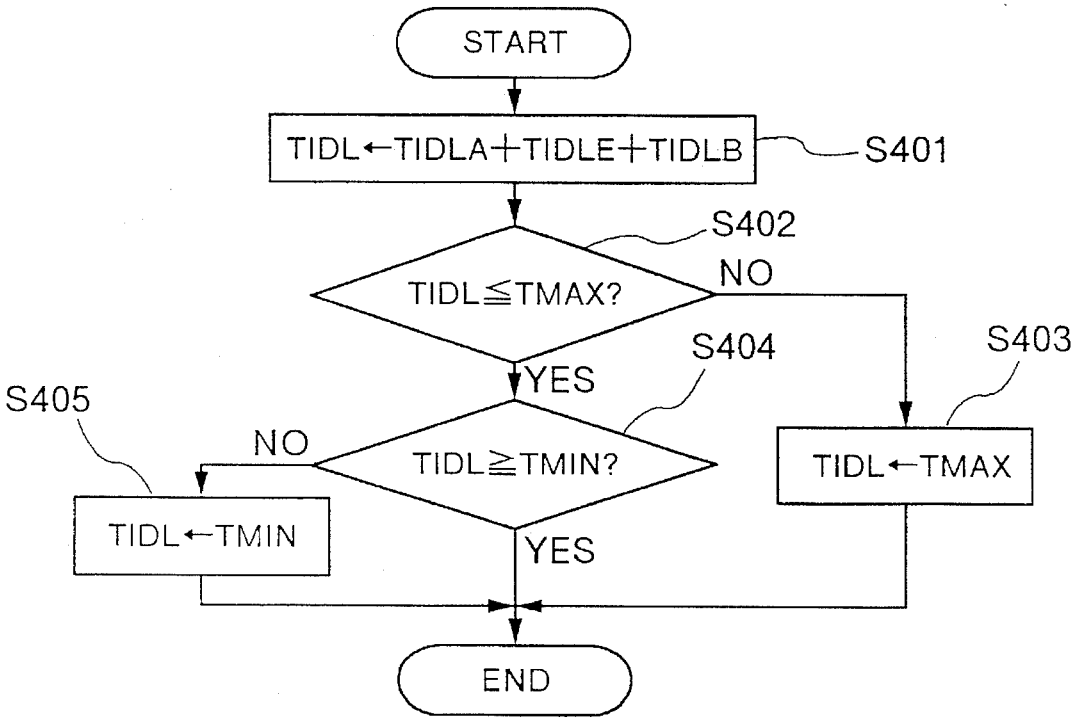
FIG. 10 shows a map used in the subroutine of FIG. 9.
FIG. 11 is a subroutine diagram showing a processing procedure for calculating TIDL (ISC target opening) shown in FIG. 4.

Then processing proceeds to step S300 shown in FIG. 4, and processing for calculating TIDLB (ISC base throttle opening) is carried out on the basis of FIGS. 9 and 10. This TIDLB (ISC base throttle opening) refers to the opening of the throttle valve serving as the reference in ISC. In the subroutine shown in FIG. 9, XNSW (neutral position signal) supplied from the neutral position switch 14 is read at seep S301. Then processing proceeds to step S302, and XAC (air conditioner signal) fed from the air conditioner switch 15 is read. Then processing proceeds to step S303, and THW (water temperature) fed from the water temperature sensor 19 is read. Processing proceeds to step S304, and TNE (target engine speed) (rpm) is calculated from the map of FIG. 10. For example, if XNSW (neutral position signal) is in the on-state (neutral position), XAC (air conditioner signal) is in the off-state (i.e., the air conditioner is not yet used), and THW (water temperature) is 50° C., then it follows that TNE (target engine speed)= 850 rpm. When THW (water temperature) is between 80° C. and 50° C. or between 50° C. and 0° C. in FIG. 10, TNE (target engine speed) is calculated by means of interpolation. Then processing proceeds to step S305, ERN (engine speed deviation) is calculated by subtracting NE (engine speed) based upon the signal of the engine speed sensor 18 from TNE (target engine speed) calculated at step S304. The processing proceeds to step S306, and TIDLB (ISC base throttle opening) is calculated by adding TIDLB (ISC base throttle opening) of the last time to the product of ERN (engine speed deviation) of step S305 and a preset constant KIDL (engine speed deviation gain). Then processing proceeds to step S307, and it is determined whether TIDLB (ISC base throttle opening) calculated at step S306 is less than or equal to TMAX (upper limit value of ISC target throttle opening). If the expression in step S107 is not satisfied, then processing proceeds to step S308 and the TMAX (upper limit value of ISC target throttle opening) is adopted as TIDLB (ISC base throttle opening). That is to say, TIDLB (ISC base throttle opening) is adapted not to exceed TMAX (upper limit value of ISC target throttle opening). On the other hand, if the expression in step S107 is satisfied, then processing proceeds to step S309 and it is judged whether TIDLB (ISC base throttle opening) calculated at step S306 is greater than or equal to TMIN (lower limit value of ISC target throttle opening). If the expression in step S309 is not satisfied, then processing proceeds to step S310 and the TMIN (lower limit value of ISC target throttle opening) is adopted as TIDLB (ISC base throttle opening). That is to say, TIDLB (ISC base throttle opening) is adapted not to be less than TMIN (lower limit value of ISC target throttle opening). On the other hand, if the expression in step S309 is satisfied, TIDLB (ISC base throttle opening) calculated at step S306 is adopted as TIDLB (ISC base throttle opening).

<Subroutine for calculating TIDL (ISC target throttle opening) shown in FIG. 11>

Then processing proceeds to step S400 shown in FIG. 4, and processing for calculating TIDL (ISC target throttle opening) is carried out on the basis of the subrouting of FIG. 11. At step S401, TIDL (ISC target throttle opening) is calculated by adding together TIDLA (air conditioner shift expectancy) calculated in FIG. 5, TIDLE (electrical load expectancy) calculated in FIG. 7, and TIDLB (ISC base throttle opening) calculated in FIG. 9. Then processing proceeds to step S402, and it is determined whether TIDL (ISC target throttle opening) calculated at step S401 is less than or equal to TMAX (upper limit value of ISC target throttle opening). If the expression in step S402 is not satisfied, then processing proceeds to step S403 and the TMAX (upper limit value of ISC target throttle opening) is adopted as TIDL (ISC target throttle opening). That is to say, TIDL (ISC target throttle opening) is adapted not to exceed TMAX (upper limit value of ISC target throttle opening). On the other hand, if the expression in step S402 is satisfied, then processing proceeds to step S404 and it is determined whether TIDL (ISC target throttle opening) calculated at step S401 is greater than or equal to TMIN (lower limit value of ISC target throttle opening). If the expression in step S404 is not satisfied, then processing proceeds to step S405 and the TMIN (lower limit value of ISC target throttle opening) is adopted as TIDL (ISC target throttle opening). That is to say, TIDL (ISC target throttle opening) is adapted not to be less than TMIN (lower limit value of ISC target throttle opening). On the other hand, if the expression in step S404 is satisfied, TIDL (ISC target throttle opening) calculated at step S401 is adopted as TIDL (ISC target throttle opening). The ISC means M11 is implemented by steps S100 to S400 shown in FIG. 4.

Figure 12:
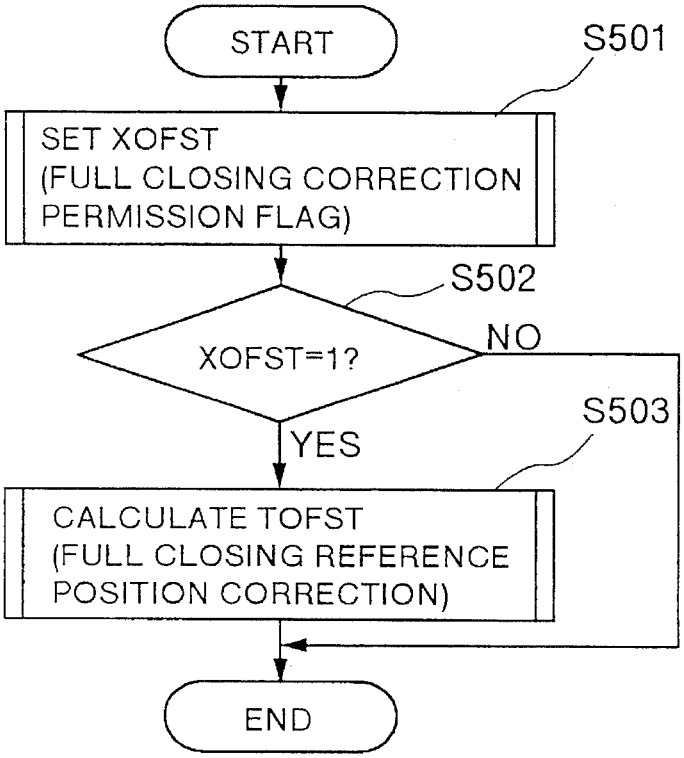
FIG. 12 is a main routine diagram showing a processing procedure for calculating TOFST (full closing reference position correction)

<Main routine for calculating TOFST (full closing reference position correction) shown in FIG. 12>

Then processing proceeds to step S500 shown in FIG. 4, and processing for calculating TOFST (full closing reference position correction) is carried out on the basis of FIG. 12. FIG. 12 shows the main routine for calculating TOFST (full closing reference position correction).

Figure 13:
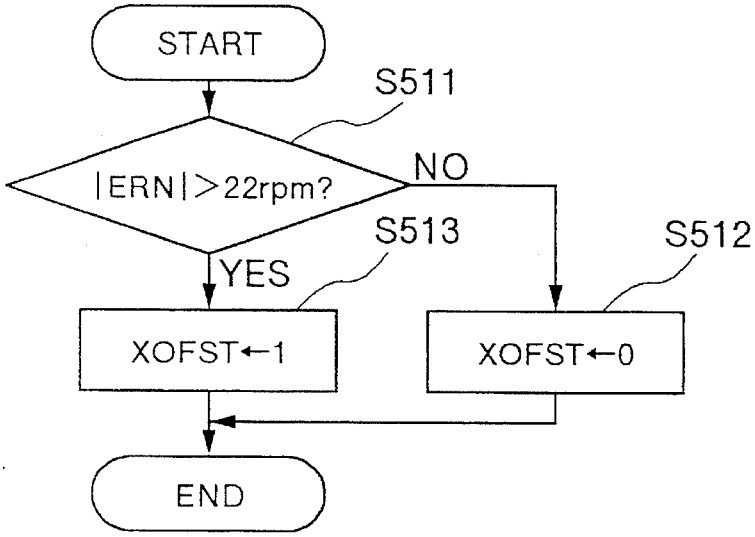
FIG. 13 is a subroutine diagram showing a processing procedure for setting XOFST (full closing correction permitting flag) shown in FIG. 12.
Figure 14:
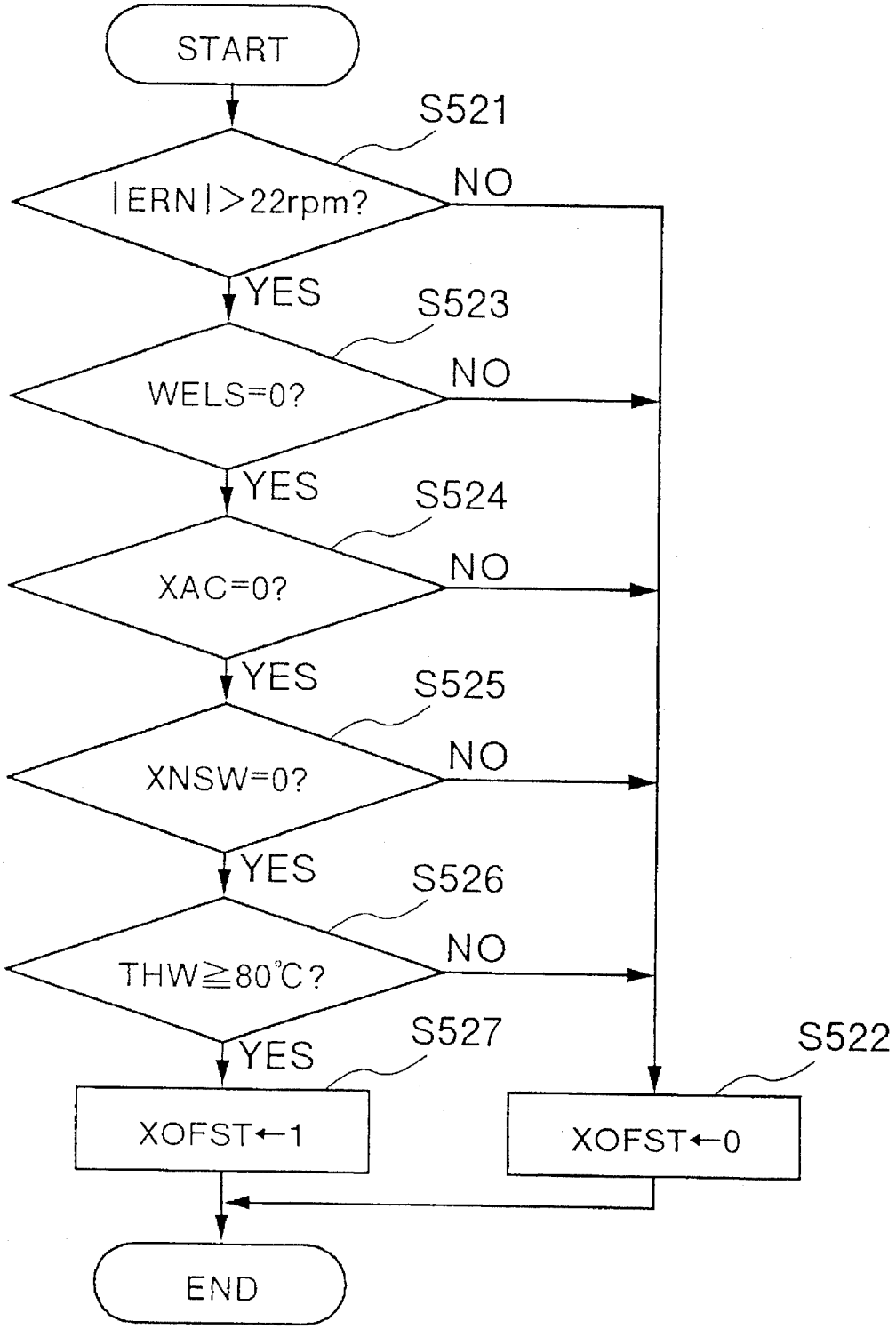
FIG. 14 is a subroutine diagram showing another processing procedure for setting XOFST (full closing correction permitting flag) shown in FIG. 12.
Figure 15:
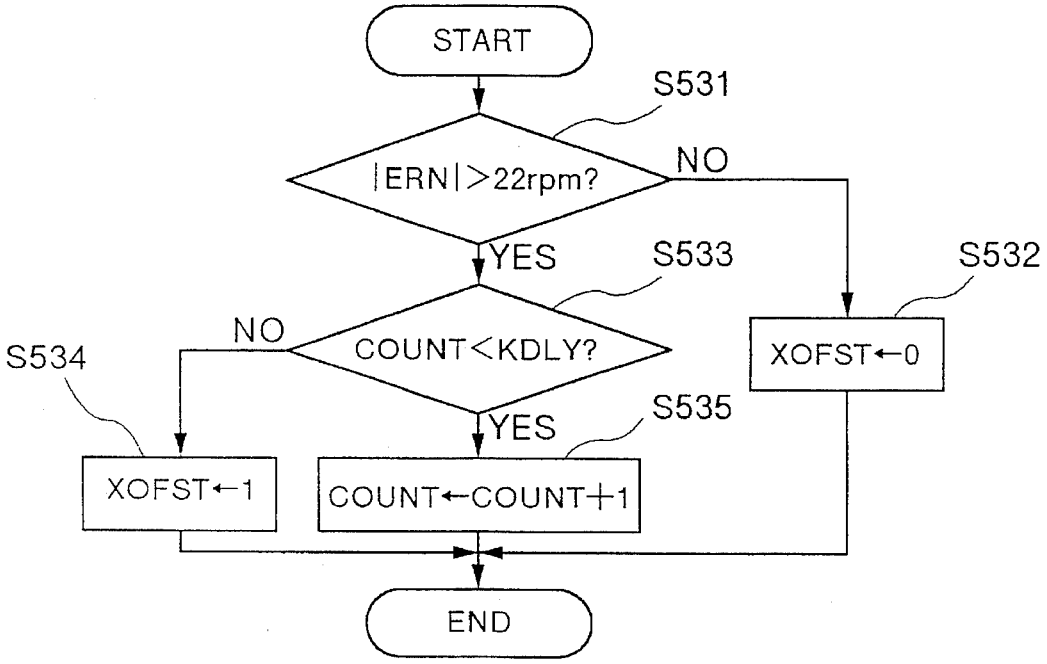
FIG. 15 is a subroutine diagram showing still another processing procedure for setting XOFST (full closing correction permitting flag) shown in FIG. 12.

<Subroutine for setting XOFST (full closing correction permitting flag) shown in FIG. 13, 14 or 15>

At step S501, processing for setting XOFST (full closing correction permitting flag) is carried out on the basis of the subroutine shown in FIG. 13. This XOFST (full closing correction permitting flag) refers to a flag for determining whether the full closing reference position should be corrected or not. Referring to FIG. 13, first of all, it is determined at step S511 whether the absolute value of ERN (engine speed deviation) calculated at step S305 in FIG. 9 exceeds 22 rpm. If the expression in step S511 is not satisfied, then processing proceeds to step S512, and the full closing reference position of the throttle valve is judged to have not changed so largely as to need correction and XOFST (full closing correction permitting flag) is set to 0 (correction is not permitted). On the other hand, if the expression in step S511 is satisfied, then processing proceeds to step 513, and it is judged that the full closing reference position of the throttle valve may have changed so largely as to need correction and XOFST (full closing correction permitting flag) is set to 1 (correction is permitted).

The processing for setting XOFST (full closing correction permitting flag) as shown in FIG. 13 may be replaced by a subroutine shown in FIG. 14. First of all, it is determined at step S521 whether the absolute value of ERN (engine speed deviation) calculated at step S305 of FIG. 9 exceeds 22 rpm. If the expression in step S521 is not satisfied, then processing proceeds to step S522, and the full closing reference position of the throttle valve is judged to have not changed so largely as to need correction and XOFST (full closing correction permitting flag) is set to 0 (correction is not permitted). On the other hand, if the expression in step S521 is satisfied, then processing proceeds to step 523, and it is determined whether WELS (electrical load signal) supplied from the electrical load switch 16 is a logic 0 (low level). If the expression in step S523 is not satisfied, then processing proceeds to step S522 and processing similar to that described above is carried out. On the other hand, if the expression in step S523 is satisfied, then processing proceeds to step S524 and it is determined whether XAC (air conditioner signal) supplied from the air conditioner switch 15 is a logic 0 (low level). If the expression in step S524 is not satisfied, then processing proceeds to step S522 and processing similar to that described above is carried out. On the other hand, if the expression in step S524 is satisfied, then processing proceeds to step S525 and it is determined whether XNSW (neutral position signal) supplied from the neutral position switch 14 is a logic 0 (low level). If the expression in step S525 is not satisfied, then processing proceeds to step S522 and processing similar to that described above is carried out. On the other hand, if the expression in step S525 is satisfied, then processing proceeds to step S526 and it is determined whether THW (water temperature) supplied from the water temperature sensor 19 is 80° C. or above. If the expression in step S526 is not satisfied, then processing proceeds to step S522 and processing similar to that described above is carried out. On the other hand, if the expression in step S526 is satisfied, then processing proceeds to step 527, and it is judged that the full closing reference position of the throttle valve may have changed so largely as to need correction and XOFST (full closing correction permitting flag) is set to 1 (correction is permitted).

Furthermore, the processing for setting XOFST (full closing correction permitting flag) as shown in FIG. 13 may be replaced by the subroutine as shown in FIG. 15. First of all, it is determined at step S531 whether the absolute value of ERN (engine speed deviation) calculated at step S305 of FIG. 9 exceeds 22 rpm. If the expression in step S531 is not satisfied, then processing proceeds to step S532, and the full closing reference position of the throttle valve is judged to have not changed so largely as to need correction and XOFST (full closing correction permitting flag) is set to 0 (correction is not permitted). On the other hand, if the expression in step S531 is satisfied, then processing proceeds to step 533, and it is determined whether COUNT (full closing correction counter) is less than KDLY (full closing correction delay time). If the expression in step S533 is not satisfied, then processing proceeds to step S534 and it is judged that the full closing reference position of the throttle valve may have changed so largely as to need correction because COUNT (full closing correction counter) is greater than or equal to KDLY (full closing correction delay time), and XOFST (full closing correction permitting flag) is set to 1 (correction is permitted). If the expression in step S533 is satisfied, then processing proceeds to step S535 and XOFST (full closing correction permitting flag) remains a logic 0 (correction is not permitted) whereas COUNT (full closing correction counter) is increased.

If the subroutine shown in FIG. 13, 14 or 15 is finished, then processing proceeds to step S502 of FIG. 12 and it is determined whether XOFST (full closing correction permitting flag) is a logic 1 (correction is permitted). If the expression in step S502 is not satisfied, the main routine for calculating TOFST (full closing reference position correction)is finished.

<Subroutine for calculating TOFST (full closing reference position correction) shown in FIG. 16, 17, 18 or 19>

Figure 16:
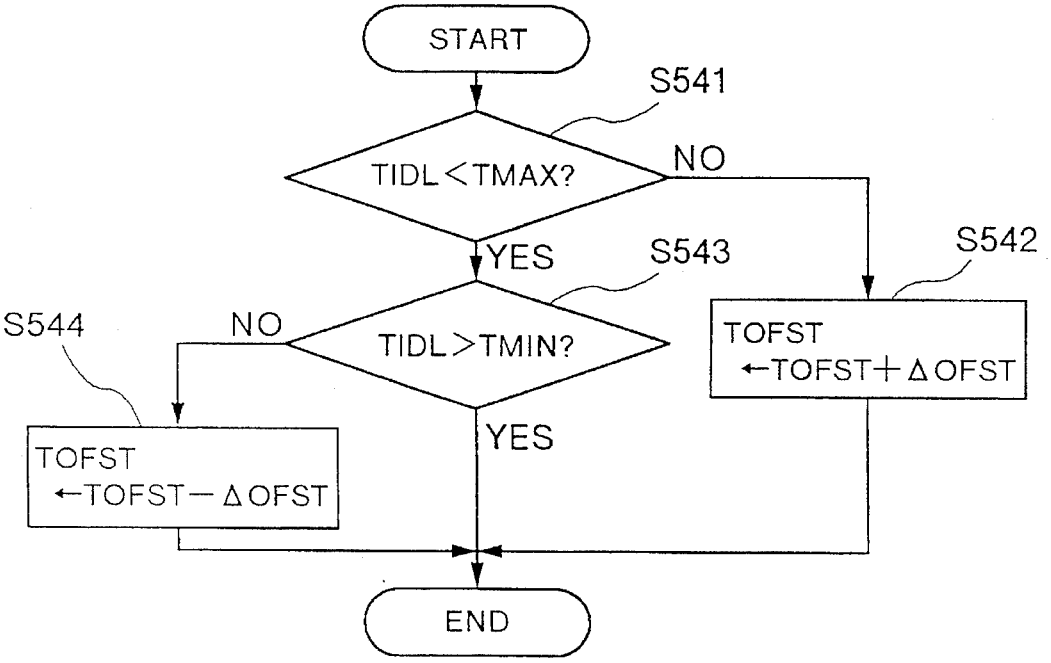
FIG. 16 is a subroutine diagram showing a processing procedure for calculating TOFST (full closing reference position correction) shown in FIG. 12.

On the other hand, if the expression in step S502 is satisfied, then processing proceeds to step S503 and the subroutine of FIG. 16 is carried out as processing for calculating TOFST (full closing reference position correction). At first, it is determined at step S541 whether TIDL (ISC target throttle opening) calculated as shown in FIG. 11 is less than TMAX (upper limit value of ISC target throttle opening). If the expression in step S541 is not satisfied, then processing proceeds to step S542, and a preset constant ΔOFST (full closing reference position correction value) is added to TOFST (full closing reference position correction), TOFST (full closing reference position correction) being thus increased by the preset constant ΔOFST (full closing reference position correction value). On the other hand, if the expression in step S541 is satisfied, then processing proceeds to step S543 and it is determined whether TIDL (ISC target throttle opening) exceeds TMIN (lower limit value of ISC target throttle opening). If the expression in step S543 is not satisfied, then processing proceeds to step S544 and the preset constant ΔOFST (full closing reference position correction value) is subtracted from TOFST (full closing reference position correction), TOFST (full closing reference position correction) being thus decreased by the preset constant ΔOFST (full closing reference position correction value). If the expression in step S543 is satisfied, the present subroutine is finished while TOFST (full closing reference position correction) before processing is being maintained. The comparison means M12 is implemented by steps S541 and S543 shown in FIG. 16, and the correction means M13 is implemented by steps S542 and S544.

Figure 17:
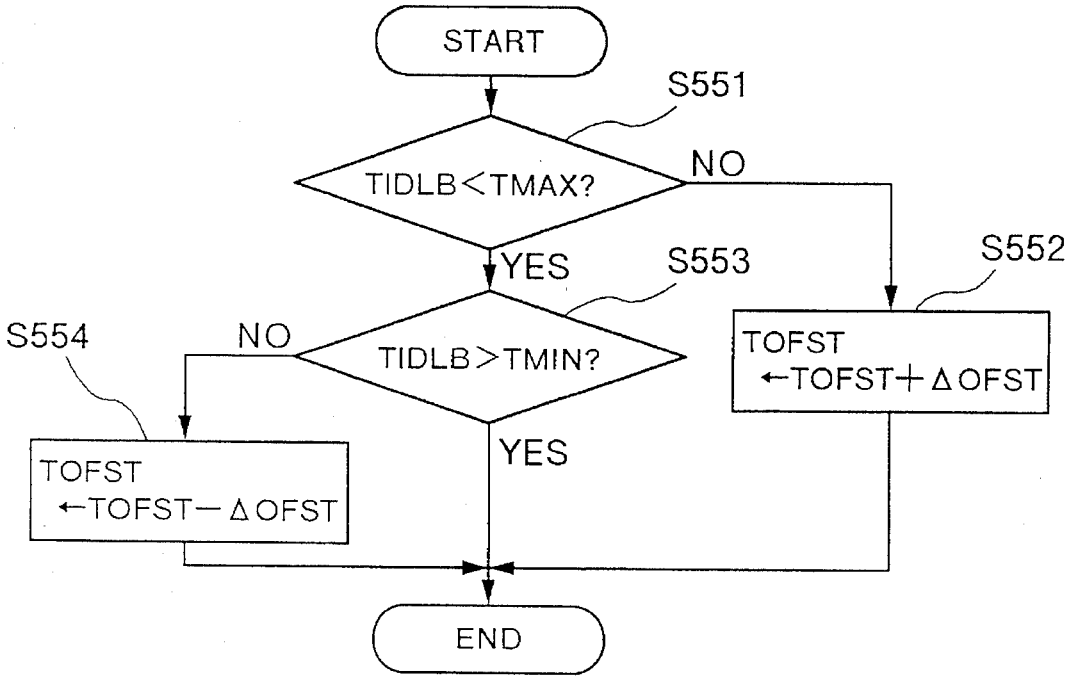
FIG. 17 is a subroutine diagram showing another processing procedure for calculating TOFST (full closing reference position correction) shown in FIG. 12.

The processing for calculating TOFST (full closing reference position correction) as shown in FIG. 16 may be replaced by the subroutine shown in FIG. 17. First of all, it is determined at step S551 whether TIDLB (ISC base throttle opening) calculated as shown in FIG. 9 is less than TMAX (upper limit value of ISC target throttle opening). If the expression in step S551 is not satisfied, then processing proceeds to step S552 and a preset constant ΔOFST (full closing reference position correction value) is added to TOFST (full closing reference position correction), TOFST (full closing reference position correction) being thus increased by the preset constant ΔOFST (full closing reference position correction value). On the other hand, if the expression in step S551 is satisfied, then processing proceeds to step S553 and it is determined whether TIDLB (ISC base throttle opening) exceeds TMIN (lower limit value of ISC target throttle opening). If the expression in step S553 is not satisfied, then processing proceeds to step S554 and the preset constant ΔOFST (full closing reference position correction value) is subtracted from TOFST (full closing reference position correction), TOFST (full closing reference position correction) being thus decreased by the preset constant ΔOFST (full closing reference position correction value). If the expression in step S553 is satisfied, then the present subroutine is finished while TOFST (full closing reference position correction) before processing is being maintained. The comparison means M12 is implemented by steps S551 and S553 shown in FIG. 17, and the correction means M13 is implemented by steps S552 and S554.

Figure 18:
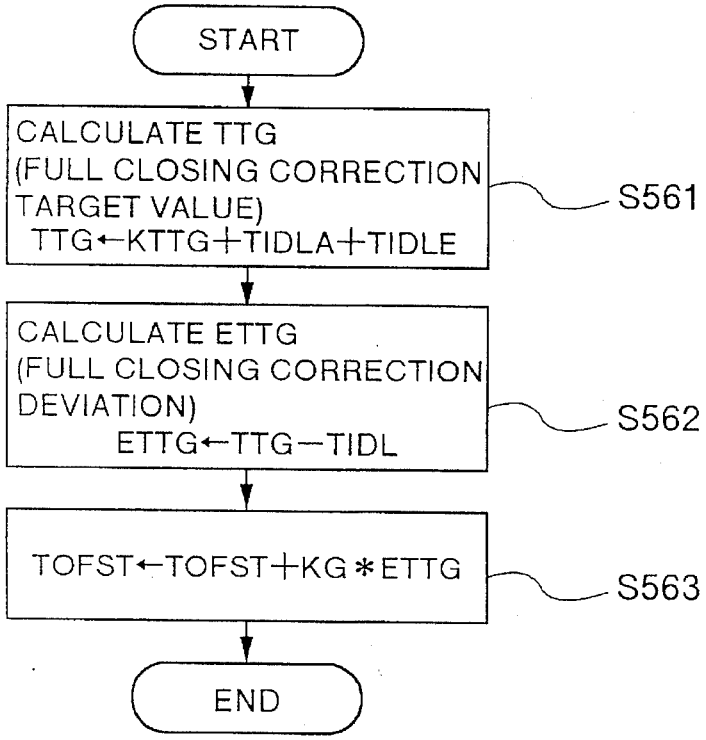
FIG. 18 is a subroutine diagram showing still another processing procedure for calculating TOFST (full closing reference position correction) shown in FIG. 12.

Furthermore, the processing for calculating TOFST (full closing reference position correction) as shown in FIG. 16 may be replaced by the subroutine shown in FIG. 18. First of all, at step S561, TTG (full closing correction target value) is calculated by adding together a preset constant KTTG (full closing correction target base opening of throttle), TIDLA (air conditioner shift expectancy) calculated as shown in FIG. 5, and TIDLE (electrical load expectancy) calculated as shown in FIG. 7. Then processing proceeds to step S562, and ETTG (full closing correction deviation) is calculated by subtracting TIDL (ISC target throttle opening) calculated as shown in FIG. 11 from TTG (full closing correction target value) calculated at step S561. Then processing proceeds to step S563, and TOFST (full closing reference position correction) is calculated by adding together TOFST (full closing reference position correction) of the last time and the product of ETTG (full closing correction deviation) calculated at step S562 and a preset constant KG (full closing correction gain). The present subroutine is thus finished. The comparison means M12 is implemented by FIG. 11 for calculating TIDL (ISC target throttle opening) in the processing of step S562 of FIG. 18. The correction means M13 is implemented by step S563.

Figure 19:
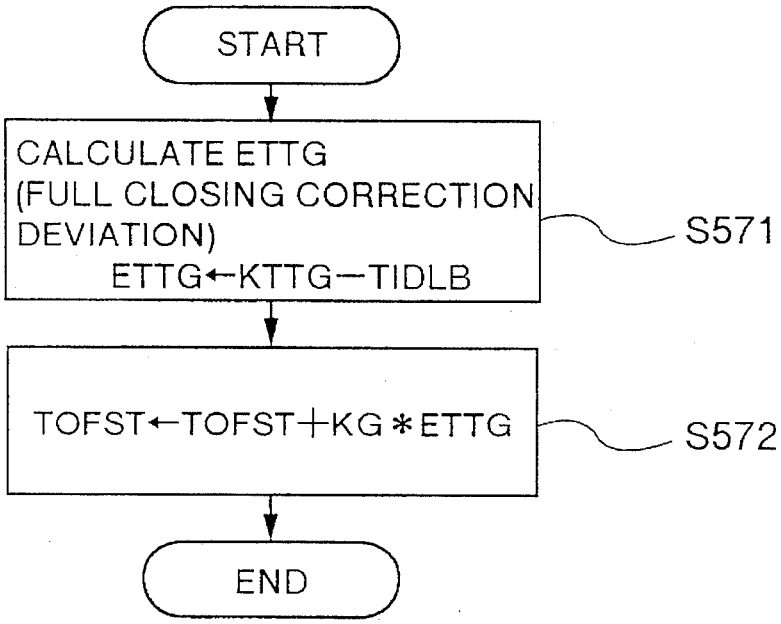
FIG. 19 is a subroutine diagram showing a further processing procedure for calculating TOFST (full closing reference position correction) shown in FIG. 12.

Furthermore, the processing for calculating TOFST (full closing reference position correction) shown in FIG. 16 may be replaced by the subroutine shown in FIG. 19. First of all, at step S571, ETTG (full closing correction deviation) is calculated by subtracting TIDLB (ISC base opening of throttle) calculated as shown in FIG. 9 from a preset constant KTTG (full closing correction target base opening of throttle). Then processing proceeds to step S572, and TOFST (full closing reference position correction) is calculated by adding together TOFST (full closing reference position correction) and the product of ETTG (full closing correction deviation) calculated at step S571 and a preset constant KG (full closing correction gain). The present subroutine is thus finished. The comparison means M12 is implemented by FIG. 9 for calculating TIDLB (ISC base opening of throttle) in the processing of step S571 of FIG. 19. The correction means M13 is implemented by step S572.

Concurrently with termination of the subroutine shown in one of FIGS. 16 to 19 described above, the main routine for calculating TOFST (full closing reference position correction) shown in FIG. 12 is finished and processing proceeds to step S600 shown in FIG. 4. At step S600, TIDLO (ISC target opening of throttle after correction) is calculated by adding together TIDL (ISC target opening of throttle) calculated at step S400 and TOFST (full closing reference position correction) calculated at step S500.

In this way, the processing of step S1 of FIG. 3 in the present embodiment involves the ISC means M11, the comparison means M12, and the correction means M13. The throttle valve control apparatus for internal combustion engine according to the embodiment of the first aspect is thus implemented.

Therefore, the deviation in throttle opening between the actual engine speed in idle operation and the target engine speed comes within a predetermined range set by an upper limit value and a lower limit value. Without conducting full closure mechanically, the full closing reference position varying due to a change with the passage of time is corrected as the occasion may demand.

In vehicles employing the throttle valve control apparatus for internal combustion engine according to the present embodiment, therefore, occurrence of an engine stall is prevented and the engine speed in idle operation can be made stable all the times even if various conditions vary.

Figure 20:
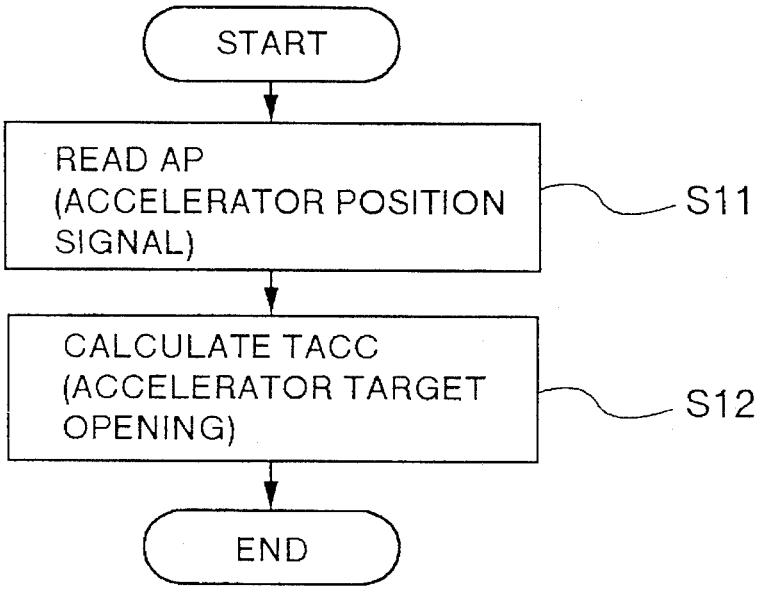
FIG. 20 is a subroutine diagram showing a processing procedure for calculating TACC (accelerator target opening) shown in FIG. 3.

<Subroutine for calculating TACC (accelerator target opening) shown in FIG. 20>

Figure 21:
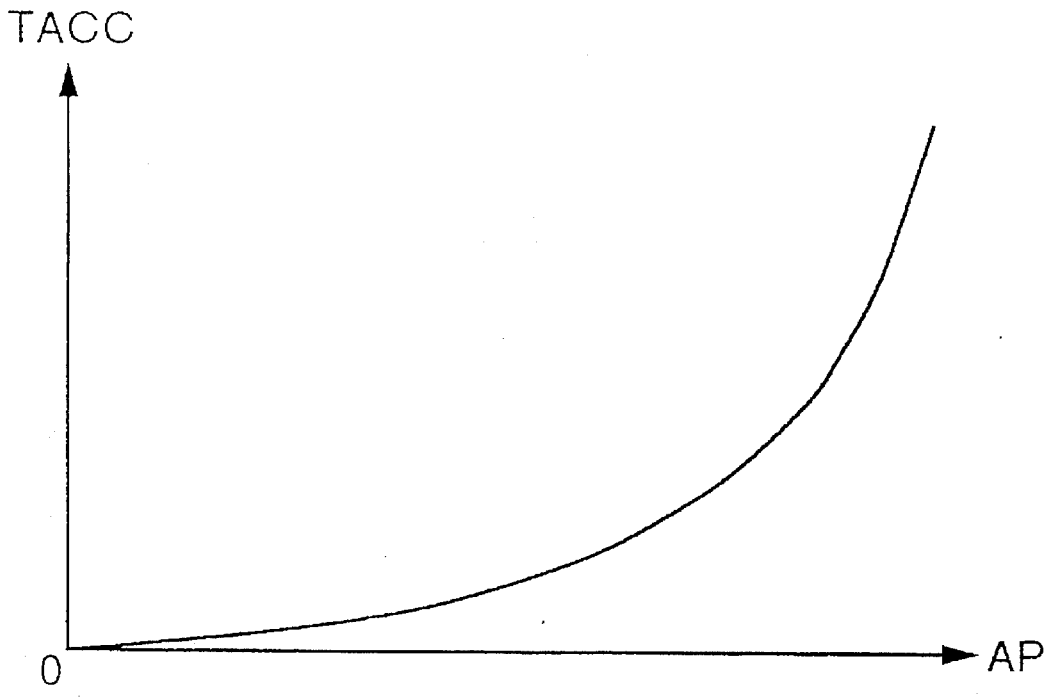
FIG. 21 is a map showing the relation between AP and TACC used in the subroutine of FIG. 20.

After the main routine for calculating TIDLO (ISC target opening of throttle after correction) as shown in FIG. 4 has been finished, the subroutine for calculating TACC (accelerator target opening) at step S2 of FIG. 3 is carried out. At step S11, AP (accelerator position signal) supplied from the accelerator position sensor 17 is read. Then processing proceeds to step S12, and TACC (accelerator target opening) corresponding to AP (accelerator position signal) read at step S11 is calculated from the map of FIG. 21 showing the relation between AP and TACC. Then processing proceeds to step S3 of FIG. 3 implementing the adding means M14, and TTA (target throttle opening) is calculated by adding TIDLO (ISC target opening of throttle after correction) of step S1 and TACC (accelerator target opening) of step S2. The present main routine is thus finished.

In this way, by the processing of the main routine including steps S1 to S3 for calculating TTA (target throttle opening) as shown in FIG. 3, the ISC means M11, the comparison means M12, the correction means M13, the adding means M14, and the throttle opening control means M15 including an actuator drive circuit 21 whereto calculated TTA (target throttle opening) is outputted are implemented. The throttle valve control apparatus for internal combustion engine according to the embodiment of the second aspect is thus implemented.

In a vehicle using a throttle valve control apparatus for internal combustion engine according to the present embodiment, therefore, the engine speed in idle operation is always stabilized and the throttle opening in output control associated with ordinary actuation of the accelerator pedal contains the throttle opening in idle operation. As a result, the throttle valve is opened or closed smoothly and continuously in response to actuation of the accelerator pedal.

In a vehicle using a throttle valve control apparatus for internal combustion engine according to the present embodiment, therefore, occurrence of an engine stall is prevented and the engine speed in idle operation is always stabilized even if various conditions change. In addition, the timing of depression of the accelerator pedal coincides with the timing of acceleration start of the vehicle.

Figure 22:
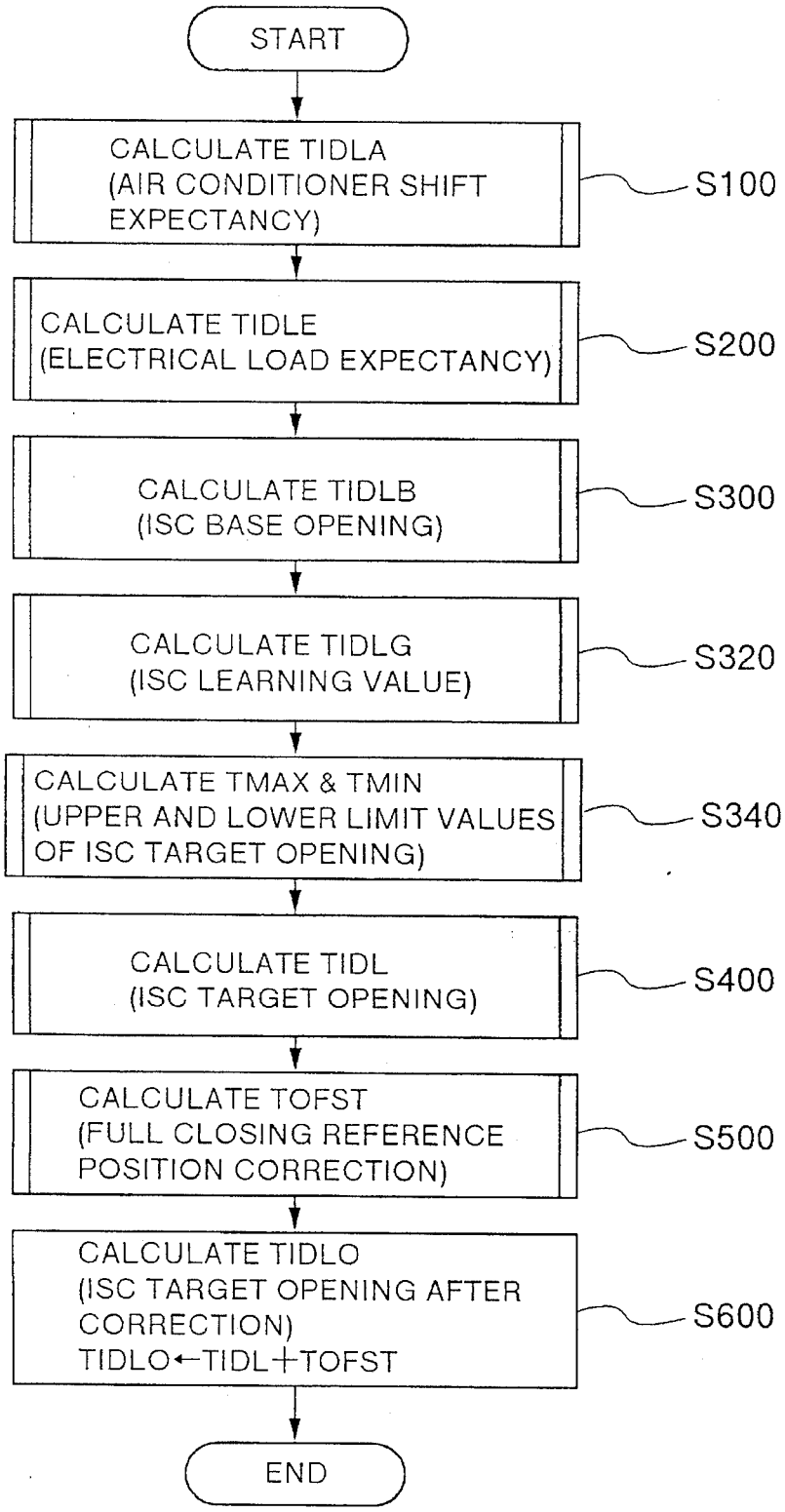
FIG. 22 is a main routine diagram showing another processing procedure for calculating TIDLO (ISC target opening after correction) shown in FIG. 3.

<Subroutine for calculating TIDLO (ISC target opening of throttle after correction) shown in FIG. 22>

The above described main routine for calculating TIDLO (ISC target opening of throttle after correction) at step S1 of FIG. 3 may be replaced by the routine shown in FIG. 22. Step S100, step S200, step S300, step S400, step S500, and S600 of FIG. 22 correspond to respective steps of FIG. 4. Since in each of these steps similar processing is carried out, description thereof will omitted. That is to say, FIG. 22 differs from FIG. 4 only in having steps S320 and S340 inserted between step S300 and step S400.

Figure 23:
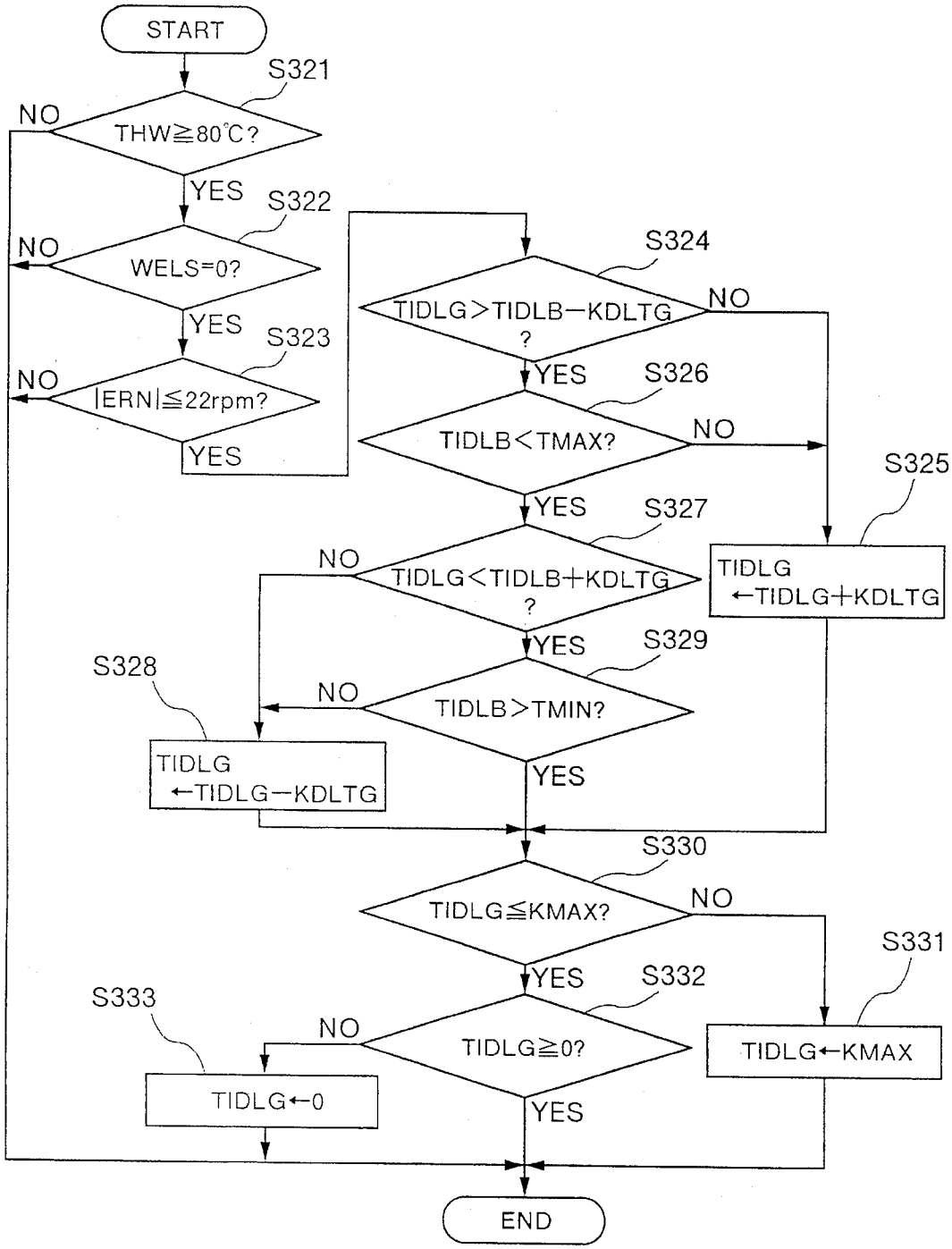
FIG. 23 is a subroutine diagram showing a processing procedure for calculating TIDLG (ISC learning value) shown in FIG. 22.

<Subroutine for calculating TIDLG (ISC learning value) shown in FIG. 23>

TIDLG (ISC learning value) of step S320 in FIG. 22 is calculated by the subroutine shown in FIG. 23. First of all, it is determined at step S321 whether THW (water temperature) is 80° or above. If the expression in step S321 is not satisfied, the present subroutine is finished. If the expression in step S321 is not satisfied, then processing proceeds to step S322 and it is determined whether WELS (electrical load signal) is 0. If the expression in step S322 is not satisfied, the present subroutine is finished. If the expression in step S322 is satisfied, then processing proceeds to step S323 and it is determined whether the absolute value of ERN (engine speed deviation) is 22 rpm or less. If the expression in step S323 is not satisfied, the present subroutine is finished. If the expression in step S323 is satisfied, then processing proceeds to step S324 and it is determined whether TIDLG (ISC learning value) exceeds TIDLB (ISC base opening of throttle) minus a preset constant KDLTG (ISC learning gain). If the expression in step S324 is not satisfied, then processing proceeds to step S325 to calculate TIDLG (ISC learning value) by adding KDLTG (ISC learning gain) to TIDLG (ISC learning value) and processing proceeds to step S330 which will be described later. If the expression in step S324 is satisfied, then processing proceeds to step S326 and it is determined whether TIDLB (ISC base opening of throttle) is less than TMAX (upper limit value of ISC target opening of throttle). If the expression in step S326 is not satisfied, then processing proceeds to the above described step S325 and similar processing is carried out. If the expression in step S326 is satisfied, then processing proceeds to step 327 and it is determined whether TIDLG (ISC learning value) is less than the sum of TIDLB (ISC base opening of throttle) and the preset KDLTG (ISC learning gain). If the expression in step S327 is not satisfied, then processing proceeds to step S328 to calculate TIDLG (ISC learning value) by subtracting KDLTG (ISC learning gain) from TIDLG (ISC learning value) and processing proceeds to step S330 which will be described later. If the expression in step S327 is satisfied, processing proceeds to step S329 and it is determined whether TIDLB (ISC base opening of throttle) exceeds TMIN (lower limit value of ISC target opening of throttle). If the expression in step S329 is not satisfied, then processing proceeds to the above described step S328 and similar processing is carried out. If the expression in step S329 is satisfied, then processing proceeds to step S330 and it is determined whether TIDLG (ISC learning value) is less than or equal to KMAX (upper limit value of ISC learning). If the expression in step S330 is not satisfied, then processing proceeds to step S331. At step S331, KMAX (upper limit value of ISC learning) is adopted as TIDLG (ISC learning value), i.e., TIDLG (ISC learning value) is kept under guard, and then the present subroutine is finished. If the expression in step S330 is satisfied, then processing proceeds to step S332 and it is determined whether TIDLG (ISC learning value) is 0 or more. If the expression in step S332 is not satisfied, then processing proceeds to step S333. At step S333, TIDLG (ISC learning value) is set to 0, i.e., TIDLG (ISC learning value) is kept under guard, and then the present subroutine is finished. If the expression in step S332 is satisfied, then TIDLG (ISC learning value) calculated before step S330 is maintained and the present subroutine is finished.

Figure 24:
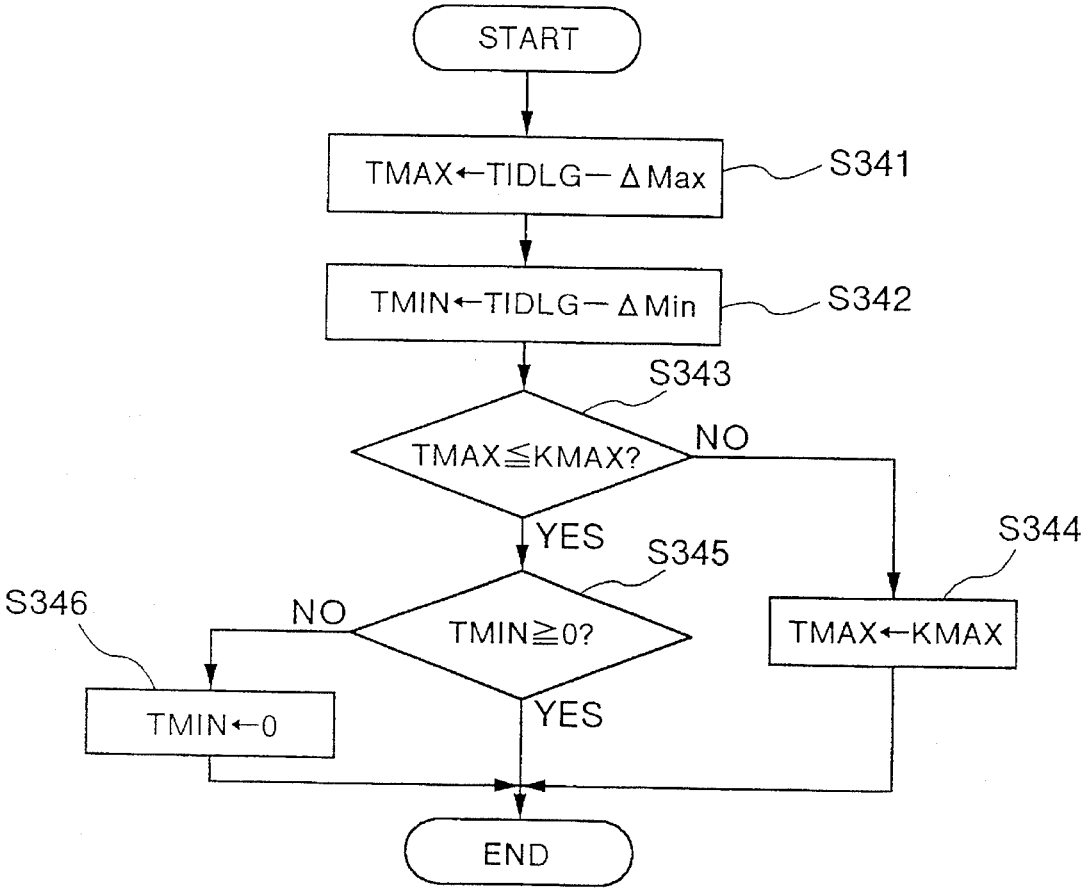
FIG. 24 is a subroutine diagram showing a processing procedure for calculating TMAX and TMIN (upper limit value and lower limit value of ISC target opening)

<Subroutine for calculating TMAX and TMIN (upper limit value and lower limit value of ISC target opening of throttle) shown in FIG. 24>

Then processing proceeds to step S340 of FIG. 22. At step S340, TMAX (upper limit value of ISC target opening) and TMIN (lower limit value of ISC target opening) are calculated by a subroutine shown in FIG. 24. First of all, at step S341, TMAX (upper limit value of ISC target opening) is calculated by subtracting ΔMax (ISC target upper limit width) from TIDLG (ISC learning value). Then processing proceeds to step S342, and TMIN (lower limit value of ISC target opening) is calculated by subtracting ΔMin (ISC target lower limit width) from TIDLG (ISC learning value). Then processing proceeds to step S343, and it is determined whether TMAX (upper limit value of ISC target opening) is less than or equal to KMAX (upper limit value of ISC learning). If the expression in step S343 is not satisfied, then processing proceeds to step S344. At step S344, KMAX (upper limit value of ISC learning) is adopted as TMAX (upper limit value of ISC target opening), i.e., TMAX (upper limit value of ISC target opening) is kept under guard, and then the present subroutine is finished. If the expression in step S343 is satisfied, processing proceeds to step S345 and it is determined whether TMIN (lower limit value of ISC target opening) is equal to 0 or more. If the expression in step S345 is not satisfied, processing proceeds to step S346. At step S346, TMIN (lower limit value of ISC target opening) is set to 0, i.e., TMIN (lower limit value of ISC target opening) is kept under guard, and the present subroutine is finished. If the expression in step S345 is satisfied, then TMAX (upper limit value of ISC target opening) and TMIN (lower limit value of ISC target opening) calculated before step S343 are maintained and the present subroutine is finished.

Figure 25:
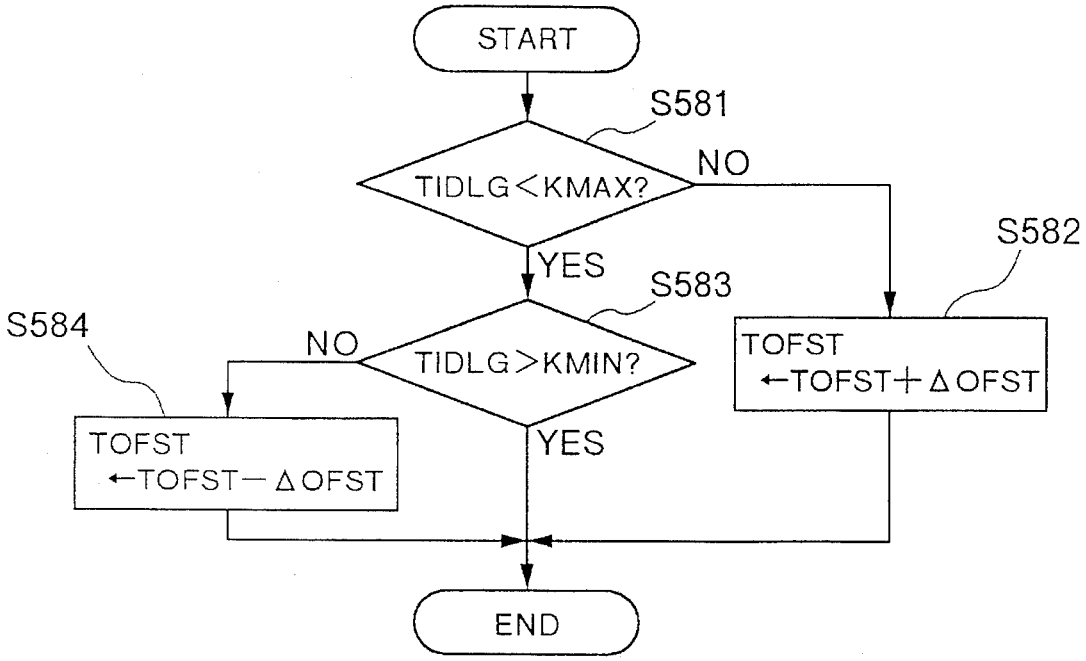
FIG. 25 is a subroutine diagram showing a processing procedure for calculating TOFST (full closing reference position correction) shown in FIG. 22.
Figure 26:
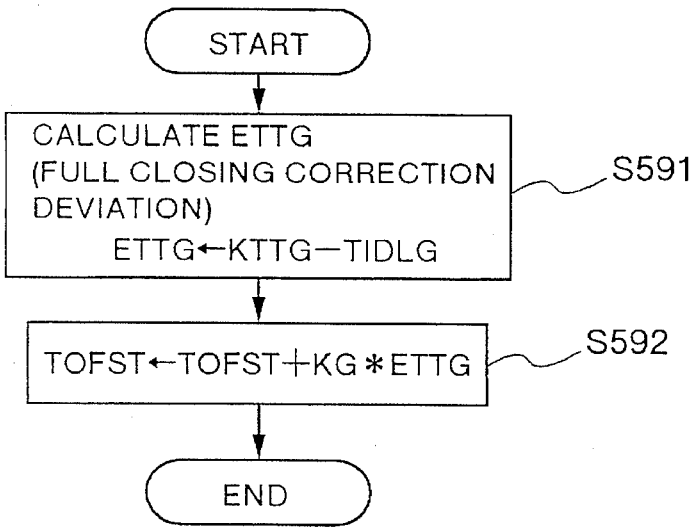
FIG. 26 is a subroutine diagram showing another processing procedure for calculating TOFST (full closing reference position correction) shown in FIG. 22.

<Subroutine for calculating TOFST (full closing reference position correction) shown in FIG. 25 or 26>

Furthermore, the processing for calculating TOFST (full closing reference position correction) at step S503 of FIG. 12 functioning as the subroutine of seep S500 of FIG. 22 may be conducted by using a subroutine as shown in FIG. 25. First of all, it is determined at step S581 whether TIDLG (ISC learning value) is less than KMAX (upper limit value of ISC learning). If the expression in step S581 is not satisfied, processing proceeds to step S582 and a preset constant ΔOFST (full closing reference position correction value) is added to TOFST (full closing reference position correction), thus TOFST (full closing reference position correction) being increased by the preset constant ΔOFST (full closing reference position correction value). On the other hand, if the expression in step S581 is satisfied, then processing proceeds to step S583 and it is determined whether TIDLG (ISC learning value) exceeds KMIN (lower limit value of ISC learning). If the expression in step S583 is not satisfied, then processing proceeds to step S584 and the preset constant ΔOFST (full closing reference position correction value) is subtracted from TOFST (full closing reference position correction), thus TOFST (full closing reference position correction) being decreased by the preset constant ΔOFST (full closing reference position correction value). If the expression in step S583 is not satisfied, then TOFST (full closing reference position correction) before processing is maintained and the present subroutine is finished.

Furthermore, the processing for calculating TOFST (full closing reference position correction) shown in FIG. 25 may be replaced by a subroutine shown in FIG. 26. First of all, ETTG (full closing correction deviation) is calculated by subtracting TIDLG (ISC learning value) from a preset constant KTTG (full closing correction target base opening) at step S591. Then processing proceeds to step S592 and TOFST (full closing reference position correction) is calculated by adding together TOFST (full closing reference position correction) of the last time and the product of ETTG (full closing correction deviation) calculated at step S591 and a preset constant KG (full closing correction gain), thus the present subroutine being finished.

In the above described embodiment as well, the deviation in throttle opening between the actual engine speed in idle operation and the target engine speed comes within a predetermined range set by the upper limit value and the lower limit value, and the full closing reference position varied by a change with passage of time or the like is corrected as occasion demands without conducting mechanical full closure. In vehicles using the throttle valve control apparatus for internal combustion engine according to the present embodiment, therefore, occurrence of an engine stall is prevented and the engine speed in idle operation can be always stabilized even if various conditions change.

In this way, the ISC means of the above described embodiment has been implemented by steps S100 to S400 of FIG. 4 as described above. In practicing the present invention, however, any means may be used so long as it controls a single throttle valve on the basis of a throttle opening calculated so as to make the actual speed of the internal combustion engine in idle operation equivalent to the target speed stored beforehand for idle operation.

Furthermore, the comparison means of the above described embodiment has been implemented by steps S541 and S543 of FIG. 16 as described above. In practicing the present invention, however, the comparison means is not restricted thereto but any means may be used so long as it compares the throttle opening in idle operation calculated by the ISC means with the upper limit value and lower limit value preset beforehand for the throttle opening in idle operation.

The correction means of the above described embodiment has been implemented by steps S542 and S544 as described above. In practicing the present invention, however, the correction means is not restricted thereto but any means may be used so long as it corrects the full closing reference position of the above described throttle opening on the basis of a result obtained by the comparison means.

Furthermore, the adding means of the above described embodiment has been implemented by step S3 of FIG. 3 as described above. In practicing the present invention, however, the adding means is not restricted thereto but any means may be used so long as it calculates the sum of the throttle opening in idle operation calculated by the ISC means, the throttle opening calculated in output control caused by ordinary actuation of the accelerator pedal other than the ISC means, and the full closing reference position of the throttle opening.

Furthermore, the throttle opening control means of the above described embodiment has been implemented by the actuator drive circuit 21 as described above. In practicing the present invention, however, the throttle opening control means is not restricted thereto but any means may be used so long as it controls the throttle opening of the throttle valve so as to make the throttle opening of the throttle valve coincide with the throttle opening calculated by the adding means.

In the throttle valve control apparatus for internal combustion engine according to the first aspect as heretofore described, the throttle opening in idle operation calculated by the ISC means using a single throttle valve is compared with the preset upper limit value and lower limit value of the throttle opening in idle operation, and a correction is made so that the throttle opening in idle operation may come within a predetermined range set by the upper limit value and the lower limit value. In making this correction, a correction using mechanical full closure is not needed and the full closing reference position varied by a change with passage of time or the like is corrected as occasion demands. This results in an effect that the engine speed in idle operation is extremely stabilized.

In the throttle valve control apparatus for internal combustion engine according to the second aspect as heretofore described, the throttle opening in idle operation calculated by the ISC means using a single throttle valve, the throttle opening calculated in output control caused by ordinary actuation of the accelerator pedal other than the ISC means, and the full closing reference position are added together. That is to say, the throttle opening calculated in output control caused by ordinary actuation of the accelerator pedal contains the throttle opening in idle operation. Therefore, the throttle valve is opened or closed smoothly and continuously. This results in an effect that the timing of depression of the accelerator pedal coincides with the timing of acceleraton start of the vehicle.

We claim:

1. A throttle valve control apparatus for internal combustion engine comprising:

idle speed control means for controlling a single throttle valve based on a throttle opening calculated so as to make an actual speed of an internal combustion engine in idle operation equal to a target speed stored beforehand for idle operation;

adding means for calculating a sum of the throttle opening in idle operation calculated by said idle speed control means, a throttle opening calculated in output control caused by ordinary actuation of an accelerator pedal other than said idle speed control means, and a full closing reference position of said throttle opening; and throttle opening control means for controlling the opening of said single throttle valve so as to make the opening of said single throttle valve coincide with the throttle opening calculated by said adding means.

2. A throttle valve control apparatus for internal combustion engine comprising:

idle speed control means for controlling a single throttle valve on the basis of a throttle opening calculated so as to make an actual speed of an internal combustion engine in idle operation equal to a target speed stored beforehand for idle operation;

comparison means for comparing the throttle opening in idle operation calculated by said idle speed control means with an upper limit value and a lower limit value preset for the throttle opening in idle operation; and correction means for correcting a full closing reference position of said throttle opening on the basis of a result in said comparison means.

3. A throttle valve control apparatus according to claim 2, further comprising means for permitting correction of the full closing reference position made by said correction means when a deviation of the engine speed from the target value has exceeded a predetermined value.

4. A throttle valve control apparatus according to claim 2, further comprising means for permitting correction of the full closing reference position made by said correction means if a deviation of the engine speed has been greater than or equal to a predetermined value continuously for a predetermined time.

5. A throttle valve control apparatus according to claim 2, wherein said correction means comprises means for increasing said full closing reference position by a predetermined value when said throttle opening in idle operation is greater than or equal to said upper limit value and means for decreasing said full closing reference position by a predetermined value when said throttle opening in idle operation is less than or equal to said lower limit value.

6. A throttle valve control apparatus according to claim 5, further comprising means for limiting the throttle opening in idle operation calculated by said idle speed control means to a range between said upper limit value and said lower limit value.

7. A throttle valve control apparatus for internal combustion engine comprising:

idle speed control means for controlling a single throttle valve based on a throttle opening calculated so as to make an actual speed of an internal combustion engine in idle operation equal to a target speed stored beforehand for idle operation;

comparison means for comparing the throttle opening in idle operation calculated by said idle speed control means with an upper limit value and a lower limit value preset for the throttle opening in idle operation; and correction means for correcting a full closing reference position of said throttle opening based on a result in said comparison means;

adding means for calculating a sum of the throttle opening in idle operation calculated by said idle speed control means, a throttle opening calculated in output control caused by ordinary actuation of an accelerator pedal other than said idle speed control means, and a full closing reference position of said throttle opening; and throttle opening control means for controlling the opening of said throttle valve so as to make the opening of said throttle valve coincide with the throttle opening calculated by said adding means.

8. A throttle valve control apparatus according to claim 7, further comprising means for permitting correction of the full closing reference position made by said correction means when a deviation of the engine speed from the target value has exceeded a predetermined value.

9. A throttle valve control apparatus according to claim 7, further comprising means for permitting correction of the full closing reference position made by said correction means if a deviation of the engine speed has been greater than or equal to a predetermined value continuously for a predetermined time.

10. A throttle valve control apparatus according to claim 7, wherein said correction means comprises means for increasing said full closing reference position by a predetermined value when said throttle opening in idle operation is greater than or equal to said upper limit value and means for decreasing said full closing reference position by a predetermined value when said throttle opening in idle operation is less than or equal to said lower limit value.

11. A throttle valve control apparatus according to claim 10, further comprising means for limiting the throttle opening in idle operation calculated by said idle speed control means to a range between said upper limit value and said lower limit value.

* * * * *